US010551141B2

(12) United States Patent
Bednar et al.

(10) Patent No.: US 10,551,141 B2
(45) **Date of Patent: *Feb. 4, 2020**

(54) NARROW CROSSBOW WITH LARGE POWER STROKE

(71) Applicant: Hunter's Manufacturing Company, Inc., Suffield, OH (US)

(72) Inventors: Richard L. Bednar, Munroe Falls, OH (US); Michael Shaffer, Mogadore, OH (US)

(73) Assignee: Hunter's Manufacturing Co., Inc., Suffield, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/213,299

(22) Filed: Dec. 7, 2018

(65) Prior Publication Data

US 2019/0113299 A1 Apr. 18, 2019

Related U.S. Application Data

(60) Continuation of application No. 15/838,561, filed on Dec. 12, 2017, now Pat. No. 10,156,416, which is a continuation of application No. 15/409,257, filed on Jan. 18, 2017, now Pat. No. 9,851,172, which is a continuation of application No. 15/261,812, filed on (Continued)

(51) Int. Cl.

| | |
|---|---|
| ***F41B 5/12*** | (2006.01) |
| ***F41B 5/10*** | (2006.01) |
| ***F41B 5/14*** | (2006.01) |

(52) U.S. Cl.
CPC ..... *F41B 5/123* (2013.01); *F41B 5/105* (2013.01); *F41B 5/12* (2013.01); *F41B 5/1469* (2013.01); *Y10T 29/49826* (2015.01)

(58) Field of Classification Search
CPC ..... F41B 5/12; F41B 5/123
See application file for complete search history.

(56) References Cited

U.S. PATENT DOCUMENTS 2,842,114 A * 7/1958 Duncan ..... F41B 5/12 124/25
4,169,456 A * 10/1979 Van House ..... F41B 5/12 124/25

(Continued)

OTHER PUBLICATIONS

Email from Karl Schwappach to Dan Fitch, Jun. 9, 2015, containing information about the Twinbow I and Twinbow II, and an attached sales receipt.

(Continued)

*Primary Examiner* — John A Ricci
(74) *Attorney, Agent, or Firm* — Emerson Thomson Bennett, LLC

(57) ABSTRACT

A crossbow assembly may include a riser and a pair of bow limbs that attach to the riser. The limb attachment surfaces on the riser may be separated such that a minimum distance between them is not greater than 5 inches. The minimum distance may be at least as wide as a user's foot. The riser may have a U-shaped opening that extends between the limb attachment surfaces. The limb attachment surfaces may be angled between 60 and 30 degrees. The riser may have a foot stirrup that begins behind the limb attachment surfaces and extends beyond them.

20 Claims, 21 Drawing Sheets

Related U.S. Application Data

Sep. 9, 2016, now Pat. No. 9,851,171, which is a division of application No. 15/005,966, filed on Jan. 25, 2016, now Pat. No. 9,528,790, which is a continuation of application No. 14/937,403, filed on Nov. 10, 2015, now Pat. No. 9,255,758, which is a continuation of application No. 14/302,764, filed on Jun. 12, 2014, now Pat. No. 9,506,716, which is a continuation of application No. 14/192,494, filed on Feb. 27, 2014, now Pat. No. 8,763,595, which is a continuation of application No. 13/848,880, filed on Mar. 22, 2013, now Pat. No. 8,794,225, which is a continuation of application No. 13/312,161, filed on Dec. 6, 2011, now Pat. No. 8,439,025, which is a division of application No. 12/868,012, filed on Aug. 25, 2010, now Pat. No. 8,191,541, which is a continuation-in-part of application No. 11/948,319, filed on Nov. 30, 2007, now Pat. No. 7,832,386.

(60) Provisional application No. 60/868,157, filed on Dec. 1, 2006.

(56) References Cited

U.S. PATENT DOCUMENTS

| | | | | |
|---|---|---|---|---|
| 4,722,318 | A * | 2/1988 | Yankey | F41B 5/143 124/25 |
| 4,766,874 | A * | 8/1988 | Nishioka | F41B 5/12 124/25 |
| 5,092,308 | A | 3/1992 | Sheffield | |
| 5,119,797 | A * | 6/1992 | Anderson | F41B 5/143 124/24.1 |
| 5,353,777 | A | 10/1994 | Fincher | |
| 5,408,982 | A | 4/1995 | Doornenbal | |
| 5,507,270 | A | 4/1996 | Smith | |
| 5,592,929 | A | 1/1997 | Hoyt, Jr. | |
| 5,630,405 | A * | 5/1997 | Nizov | F41B 5/123 124/25 |
| 5,671,723 | A | 9/1997 | Goff et al. | |
| 5,934,264 | A | 8/1999 | Doornenbal | |
| 6,024,076 | A | 2/2000 | Laborde et al. | |
| 6,161,532 | A | 12/2000 | Goff et al. | |
| 6,460,528 | B1 * | 10/2002 | Gallops, Jr. | F41B 5/105 124/25 |
| 6,758,204 | B1 | 7/2004 | Goff et al. | |
| 6,886,549 | B2 | 5/2005 | McPherson | |
| 6,901,921 | B1 * | 6/2005 | Barnett | F41B 5/123 124/25 |
| 7,100,590 | B2 * | 9/2006 | Chang | F41B 5/123 124/25 |
| 7,174,884 | B2 | 2/2007 | Kempf et al. | |
| 7,258,113 | B2 | 8/2007 | Pilpel et al. | |
| 7,328,693 | B2 * | 2/2008 | Kempf | F41B 5/123 124/25 |
| 7,363,921 | B2 * | 4/2008 | Kempf | F41B 5/105 124/25 |
| 7,743,760 | B2 | 6/2010 | Woodland | |
| 7,823,572 | B2 * | 11/2010 | Anderson | F41B 5/123 124/25 |
| 7,832,386 | B2 * | 11/2010 | Bednar | F41B 5/123 124/25 |
| 7,836,871 | B2 * | 11/2010 | Kempf | F41B 5/1469 124/25 |
| 7,891,348 | B2 * | 2/2011 | Colley | F41B 5/123 124/25 |
| 7,938,108 | B2 * | 5/2011 | Popov | F41B 5/123 124/25 |
| 8,191,541 | B2 | 6/2012 | Shaffer et al. | |
| 8,439,025 | B2 | 5/2013 | Shaffer et al. | |
| 8,469,012 | B2 | 6/2013 | Bednar et al. | |
| 8,479,719 | B2 * | 7/2013 | Bednar | F41B 5/105 124/25 |
| 8,671,923 | B2 * | 3/2014 | Goff | F41B 5/123 124/25 |
| 8,763,595 | B1 | 7/2014 | Bednar et al. | |
| 8,997,728 | B2 | 4/2015 | Popov et al. | |
| 9,851,172 | B2 * | 12/2017 | Bednar | F41B 5/105 |
| 10,156,416 | B2 * | 12/2018 | Bednar | F41B 5/105 |

OTHER PUBLICATIONS

Precision Shooting Equipment Catalog, 1983.
Precision Shooting Equipment Catalog, 1984.
Precision Shooting Equipment Catalog, 1985.
Precision Shooting Equipment Catalog, 1986.
Precision Shooting Equipment Catalog, date unknown.
Precision Shooting Equipment Catalog, 1988.
Precision Shooting Equipment Catalog, 1989.
Precision Shooting Equipment Catalog, 1990.
2007 Stryker Owner's Manual.
Parker Compund Bows, Inc.'s Answer Presenting Defenses to Hunter's Amended Counterclaim, Sep. 11, 2014.
Answer Presenting Defenses to Counterclaim and Request for Declaratory Judgement Regarding the '595 Patent Aug. 7, 2014.
Complaint for Declaratory Judgment, Feb. 17, 2014.
Photography of Horton Hunter Express SL Crossbow, date unknown.
AR15.Com Retro Forum, 2006.
Roger Combs, Crossbows.
Parker Compound Bows, Inc. Cam Brushing Photographs, various dates.
Parker Bows Drawing of Cross Bow Limb (PT# 38-154), Apr. 9, 2003.
NC Manufacturing, Cross Bow Limb (PT# 6502), Apr. 9, 2003.
Parker Bows, Cross Bow Limb (PT# 38-154), Apr. 9, 2003.
NC Manufacturing, Buck Buster Limb (PT# 6551), May 18, 2006.
NC Manufacturing, Buck Buster Limb (PT# 38-1581), May 18, 2006.
Parker Bows, Buck Buster Limb (PT# 38-1581), May 18, 2006.
NC Manufacturing, X-Bow Limb (PT# 38-155), Jan. 2, 2007.
Fax Drawing Patton Archery, Limb Design Feather Grade, fax dated Jan. 18, 2000.
Fax Drawing Patton Archery, Limb Design Premium Grade, fax dated Jan. 18, 2000.
Parker Bows, Tomahawk Limb (PT# 09-38-1594), Nov. 29, 2011.
Correspondence dated Jan. 24, 2014 Regarding Barnett Crossbow DEMON and Images of Barnett Crossbow DEMON.
Barnett DEMON With Added Tape measure, date unknown.
Images of a crossbow by Horton called the SuperMag; prior to Dec. 2006.
Images of a crossbow by Swiss Crossbow called the TWINBOW; prior to Dec. 2006.
Advertisement for Stryker Crossbow; Sep./Oct. 2006.
Image of a compound bow (Not a crossbow) called the Hickory Creek DL24; prior to Dec. 2006.
Memorandum Opinion, U.S. District Court, Western District of Virginia, *Parker Compound Bows, Inc.* v. *Hunter's Mfg. Co., Inc.* d/b/a TenPoint Crossbow Tech., Case No. 5:14-cv-00004, Feb. 12, 2016.
First Amended Complaint for Patent Infringement, Feb. 15, 2017, U.S. District Court, Northern District of Ohio, *Hunter's Manufacturing Company, Inc.* v. *SA Sports, LLC*, Case No. 5:16-cv-03075-JRA.
Answer, Affirmative Defenses, and Counterclaims of Defendant, SA Sports, LLC, to First Amended Complaint for Patent Infringement, Apr. 5, 2017.
Arrow Trade, Crossbow Lines 2002, Hickory Creek Compound bow with draw-lock Advertisement, Matthews Legacy Advertisement, May 2002.
Parker Compound Bows Catalog, Parker Compound Bows Inc., date unknown.
Parker Compound Bows Catalog, Parker Compound Bows Inc., 1998.
Parker Compound Bows Catalog, Parker Compound Bows Inc., 2000.

(56) References Cited

OTHER PUBLICATIONS

Parker Compound Bows Catalog, Parker Compound Bows Inc., 2001.
Parker Crossbows Catalog, Parker Compound Bows Inc., 2003 (A).
Parker Compound Bows Catalog, Parker Compound Bows Inc., 2003 (B).
Parker Compound Bows Catalog, Parker Compound Bows Inc., 2004.
Parker Catalog, Parker Compound Bows Inc., 2005.
Parker Crossbows Catalog, Parker Compound Bows Inc., 2006.
Sporting Gear: Field-Tested Micro-Bows, Outdoor Life, Sep. 2001.
The Forward-Handle and Overdraw Bows, Bow & Arrow, Jun. 1982.
Image of Crossbow, information unknown.
Various Images of Stryker Advertisements, 2008 and various unknown dates.
Parker Crossbows Catalog, Parker Compound Bows Inc., 2007.
Parker Crossbows Catalog, Parker Compound Bows Inc., 2008.
Parker Crossbows Catalog, Parker Compound Bows Inc., 2009.
Steve Flores, Bow Report, Liberty 1, Bow & Arrow Hunting (date unknown).
Howard Winther of Liberty Archery Resilient and Inventive, Bow & Arrow Hunting, Apr. 2008.
Bill Krenz, Bow Report, Liberty 1, Inside Archery, 2006.
Bill Krenz, Bow Report, Stryker Crossbow, Inside Archery, Mar. 2007.
Stryker Advertisement, Archery Business, Sep./Oct. 2006.
Stryker Advertisement, Archery Business, Jan./Feb. 2007.
Stryker's Owner's Manual, http://www.strykerxbow.com/downloads/Owners_Manual_Stryker07.pdf, 2007.
Tim Dehn, 2008 Crossbows, Stryker Broke Barriers in Design, 2008.
News Briefs from the Archery Trade Show, The Outdoor Wire, Jan. 23, 2004.
Horton 35th Anniversary Catalog, Horton Manufacturing Company, Inc., 1999.
CR Learn, Bow Report, Fast Cat, Bow & Arrow, Oct. 1983 handwritten date, actual date unknown.
William Hovey Smith, Crossbow Hunting, Stackpole Books, Aug. 15, 2006.
2007 Stryker Owner's Manual, 2007.
Barnett 2008 Catalog, 2008.
Barnett The Adventure Continues, undated.
Barnett Crossbows "Worldwide Excellence", undated.
Barnett Crossbows (handwritten "1995 Demon Commando"), undated.
Barnett Crossbows, Barnett International, Inc. "The World Leader in High Performance Crossbows" (handwritten 1996 Demon, Mag-Cat, Ranger II, WXL), undated.
Barnett Crossbows (handwritten "2004-2005").
TenPoint 2006 Catalog, 2006.
Website printout of Hickory Creek HD-24 Compound, http://www.fastestbows.com/reviews/hickory_creek_hd-24.htm, Jul. 24, 2003.
Fax of Compound Bow, Apr. 28, 2003.
Compound Riser Fax Drawings, Jul. 17, 2001.
Miscellaneous sales receipts, invoices, notes, Hickory Creek, 2002.
Images of Compound Bow (green background), undated.
Hickory Creek Cam Drawings, NC Manufacturing, Oct. 27, 1999.
Gordon Composites, Inc., Packing Slips, sales receipts, invoices and notes, Various Dates.
Color Images of ArrowTrade Magazine, May 2002.
Hickory Creek D.L. 24, HD 24, Vertical In-Line Crossbow, 23 Magnum, date unknown.
Sheet of You Tube URL's to include: https://www.youtube.com/watch?v=uJb6r1zRzBQ; https://www.youtube.com/watch?v=FbfrTKAI8cg; http://wn.com/23_magnum_draw-loc_bow; https://www.youtube.com/watch?v=2anOMF9Gq0k; https://www.youtube.com/watch?v=oFtldD3SPRQ; and, https://www.youtube.com/watch?v=ZzUMEBZrPYQ.
Desert Stryker Owner's Manual, date unknown.
Stryker Advertisement, date unknown.

* cited by examiner

NARROW CROSSBOW WITH LARGE POWER STROKE

CROSS-REFERENCE TO RELATED APPLICATIONS

This application is a continuation of U.S. patent application Ser. No. 15/838,561, entitled NARROW CROSSBOW WITH LARGE POWER STROKE, filed Dec. 12, 2017, which is a continuation of U.S. patent application Ser. No. 15/409,257, entitled NARROW CROSSBOW WITH LARGE POWER STROKE, filed Jan. 18, 2017, which is a continuation of U.S. patent application Ser. No. 15/261,812, entitled NARROW CROSSBOW WITH LARGE POWER STROKE, filed Sep. 9, 2016, which is a division of U.S. patent application Ser. No. 15/005,966, entitled NARROW CROSSBOW WITH LARGE POWER STROKE, filed Jan. 25, 2016, which is a continuation of U.S. patent application Ser. No. 14/937,403, entitled NARROW CROSSBOW WITH LARGE POWER STROKE, filed Nov. 10, 2015, which is a continuation of U.S. Ser. No. 14/302,764, entitled NARROW CROSSBOW WITH LARGE POWER STROKE, filed Jun. 12, 2014, which is a continuation of U.S. patent application Ser. No. 14/192,494, entitled NARROW CROSSBOW WITH LARGE POWER STROKE, filed Feb. 27, 2014, which is a continuation of U.S. patent application Ser. No. 13/848,880, entitled NARROW CROSSBOW WITH LARGE POWER STROKE, filed Mar. 22, 2013, which is a continuation of U.S. Ser. No. 13/312,161, entitled NARROW CROSSBOW WITH LARGE POWER STROKE, filed Dec. 6, 2011, which is a division of U.S. patent application Ser. No. 12/868,012, entitled NARROW CROSSBOW WITH LARGE POWER STROKE, filed Aug. 25, 2010, which is a continuation-in-part of U.S. patent application Ser. No. 11/948,319, entitled NARROW CROSSBOW WITH LARGE POWER STROKE, filed Nov. 30, 2007, which claims priority from U.S. Ser. No. 60/868,157, entitled CROSSBOW, filed Dec. 1, 2006, all of which are incorporated herein by reference.

BACKGROUND

Crossbows have been used for many years as a weapon for hunting and fishing, and for target shooting. In general, a crossbow includes a main beam including a stock member and a barrel connected to the stock member. The barrel typically has an arrow receiving area for receiving the arrow that is to be shot. The crossbow also includes a bow assembly supported on the main beam that includes a bow and a bowstring connected to the bow for use in shooting arrows. A trigger mechanism, also supported on the main beam, holds the bowstring in a drawn or cocked condition and can thereafter be operated to release the bowstring out of the uncocked condition to shoot the arrow. One characteristic of a crossbow is termed a power stroke. The power stroke is the distance along the main beam that the bowstring moves between the uncocked condition and the cocked condition.

One of the trends in the industry today is to advertise very large power strokes, such as 16 inches, 17 inches or 18 inches. Such very large power strokes provide the potential for more speed and energy. But there are corresponding problems. One such problem is the added difficulty in manually cocking the crossbow. More specifically, the operator must have relatively long arms in order to properly reach the bowstring for cocking purposes. Another problem with relatively large power strokes is the increased angle of the bowstring when placing it into the cocked position. This also makes it more difficult to cock the crossbow.

Another problem with known crossbows is related to their width. More specifically, to obtain an adequate power stroke it is known to provide crossbows that are relatively wide. Such wide crossbows may be difficult for a hunter to operate while following prey, side to side, because the crossbow is less maneuverable and the hunter is more likely to bump into surrounding objects.

What is needed is a relatively narrow crossbow having a relatively large power stroke. In this way the disadvantages known in the art can be overcome in a way that is better, more efficient and that provides better overall results.

SUMMARY

According to some aspects of the present teaching, a crossbow may comprise: a main beam; a first bow limb that has: a first end supported to the main beam and a second end opposite the first end; a second bow limb that has: a first end supported to the main beam and a second end opposite the first end; and a bowstring that is: adapted to propel an arrow, received on the second end of the first bow limb and received on the second end of the second bow limb. The first end of the first bow limb and the first end of the second bow limb may be separated such that a minimum distance between them is not greater than about 5 inches; and an opening that is at least as wide as a user's foot may extend between the first end of the first bow limb and the first end of the second bow limb.

According to some aspects of the present teaching, a crossbow may comprise: a main beam having an axis of elongation; a first bow limb that has: a first end supported to the main beam and a second end opposite the first end; a second bow limb that has: a first end supported to the main beam and a second end opposite the first end; and a bowstring that is: adapted to propel an arrow, received on the second end of the first bow limb and received on the second end of the second bow limb. The first end of the first bow limb and the first end of the second bow limb may be separated such that a minimum distance between them is: at least as wide as a user's foot; but not greater than about 5 inches. A first point may be located on the first end of the first bow limb and a second point may be located on the first end of the second bow limb. A first plane may be perpendicular to the axis of elongation and may intersect the first point and a second plane may be perpendicular to the axis of elongation and may intersect the second point. The first end of the first bow limb may be positioned at a first acute angle with respect to the first plane and the first end of the second bow limb may be positioned at a second acute angle with respect to the second plane. The first acute angle may be between 60 and 30 degrees; and the second acute angle may be between 60 and 30 degrees.

According to some aspects of the present teaching, a crossbow may comprise: a main beam having an axis of elongation; a first bow limb that has: a first end supported to the main beam and a second end opposite the first end; a second bow limb that has: a first end supported to the main beam and a second end opposite the first end; a bowstring that is: adapted to propel an arrow as it moves on a first plane between cocked and uncocked positions, received on the second end of the first bow limb and received on the second end of the second bow limb; and a foot stirrup supported to the main beam. The foot stirrup may begin behind the first ends of the first and second bow limbs and extend beyond the first ends of the first and second bow limbs such that a user's foot is insertable into the foot stirrup. A first point may be located on the first end of the first bow limb; and a second point may be located on the foot stirrup. A second plane may be perpendicular to the axis of elongation and intersect the first point. The axis of elongation may lie on a third plane that is perpendicular to the first and second planes. A fourth plane that is parallel to the third plane may simultaneously intersect the first and second points.

One advantage of this invention according to one embodiment is that a relatively narrow crossbow having a relatively large power stroke is provided.

Another advantage of this invention is that a crossbow may be easy to manually cock.

Another advantage of this invention is that the fiber composition of the riser provides the crossbow with a reduced weight.

Still another advantage of this invention is that the fiber compound composition of the riser may increase the attenuation of vibration and sound resulting from firing the crossbow.

BRIEF DESCRIPTION OF THE DRAWINGS

The invention may take physical form in certain parts and arrangement of parts embodiments of which will be described in detail in this specification and illustrated in the accompanying drawings which form a part hereof and wherein.

DEFINITIONS

Figure 1:
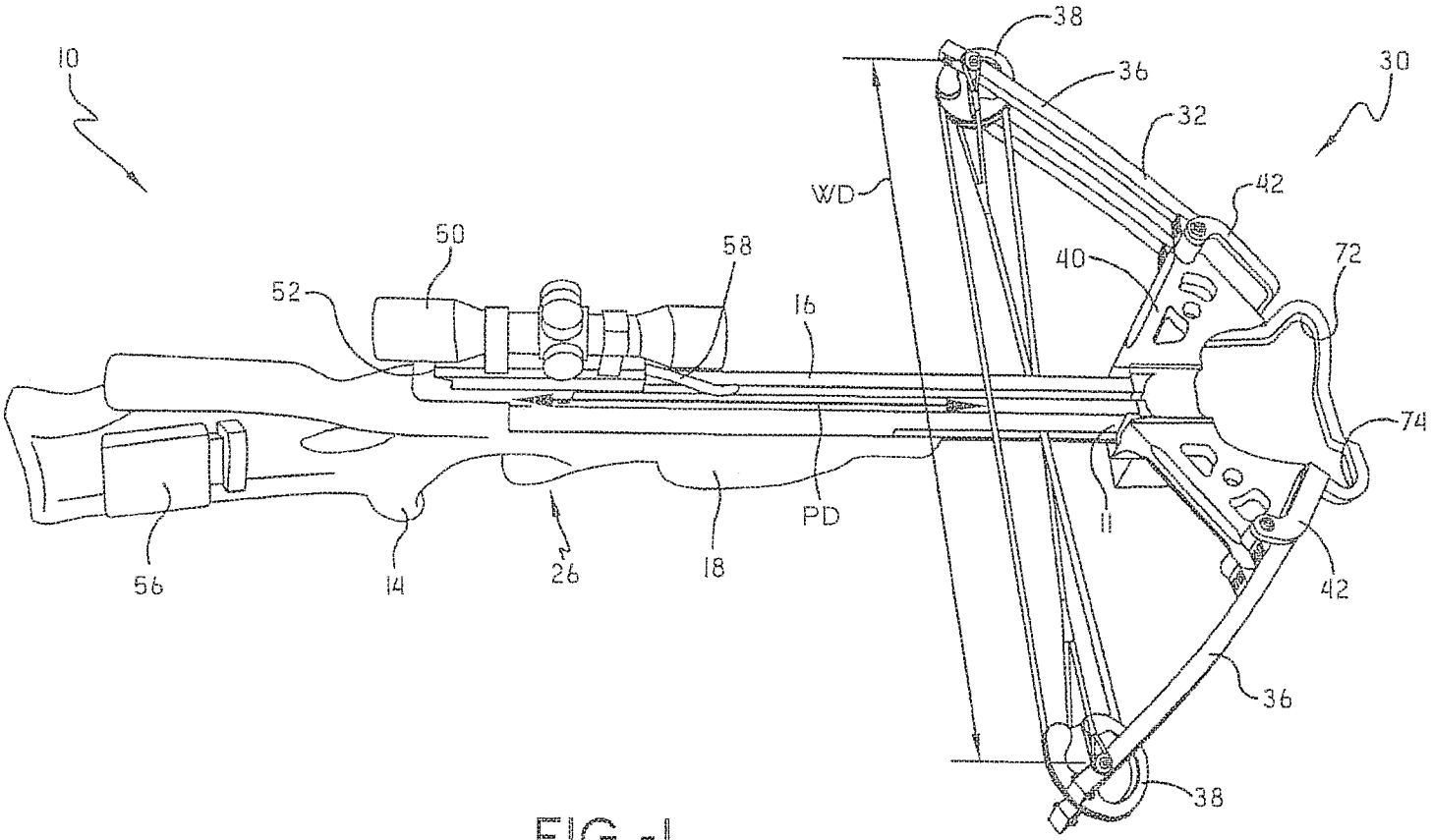
FIG. 1 is a top perspective view of a crossbow according to certain embodiments of the invention.

The following definitions are controlling for the disclosed invention:

"Arrow" means a projectile that is shot with (or launched by) a bow assembly.

"Bow" means a bent, curved, or arched object.

"Bow Assembly" means a weapon comprising a bow and a bowstring that shoots or propels arrows powered by the elasticity of the bow and the drawn bowstring.

"Bowstring" means a string or cable attached to a bow.

"Compound Bow" means a crossbow that has wheels, pulleys or cams at each end of the bow through which the bowstring passes.

"Crossbow" means a weapon comprising a bow assembly and a trigger mechanism both mounted to a main beam.

"Draw Weight" means the amount of force required to draw or pull the bowstring on a crossbow into a cocked condition.

"Main Beam" means the longitudinal structural member of a weapon used to support the trigger mechanism and often other components as well. For crossbows, the main beam also supports the bow assembly. The main beam often comprises a stock member, held by the person using the weapon, and a barrel, used to guide the projectile being shot or fired by the weapon.

"Power Stroke" means the linear distance that the bowstring is moved between the uncocked condition and the cocked condition.

"Trigger Mechanism" means the portion of a weapon that shoots, fires or releases the projectile of a weapon. As applied to crossbows, trigger mechanism means any device that holds the bowstring of a crossbow in the drawn or cocked condition and which can thereafter be operated to release the bowstring out of the drawn condition to shoot an arrow.

"Weapon" means any device that can be used in fighting or hunting that shoots or fires a projectile including bow assemblies and crossbows.

DETAILED DESCRIPTION

Referring now to the FIGURES wherein the showings are for purposes of illustrating multiple embodiments of the invention only and not for purposes of limiting the same, FIGS. 1-4 show a crossbow 10 according to one embodiment of this invention. While the crossbow shown uses a compound bow, it should be understood that this invention will work well with any type of crossbow chosen with sound judgment by a person of ordinary skill in the art. The crossbow 10 has a main beam 12 including a stock member 14 and a barrel member 16. The main beam 12 may be made by assembling the stock member 14 and the barrel member 16 together as separate components or, in another embodiment, the main beam 12 may be made as one piece. A handgrip 18 may be mounted to the main beam 12 in any conventional manner chosen with sound judgment by a person of ordinary skill in the art. A trigger mechanism 20 suitable for shooting an arrow is mounted to the main beam 12 in any suitable manner. It should be noted that the crossbow 10 may comprise any trigger mechanism chosen with sound judgment by a person of ordinary skill in the art. The crossbow 10 also includes a bow assembly 30 adapted to propel an arrow and having a bow 32 and a bowstring 34. The bow 32 includes a pair of limbs 36, 36 that receive the bowstring 34 in any conventional manner chosen with sound judgment by a person of ordinary skill in the art. For the embodiment shown, a pair of wheels or pulleys 38, 38 mounted to the limbs 36, 36 receive the bowstring 34 in a known manner. The bow may also include a riser or block 40 having a pair of limb pockets 42, 42 that receive the limbs 36, 36, as shown. Many other crossbow components may be optionally used with a crossbow using this invention. The crossbow 10 shown, for example, includes a scope 50 attached to a scope mount 52 that is supported on the main beam 12, and one or more swivel studs 54 (see FIG. 2). Other optional components shown include a cocking unit 56 and an arrow retention spring 58. As the operation of these components is well known to those of skill in the art, no further details will be provided.

Figure 2:
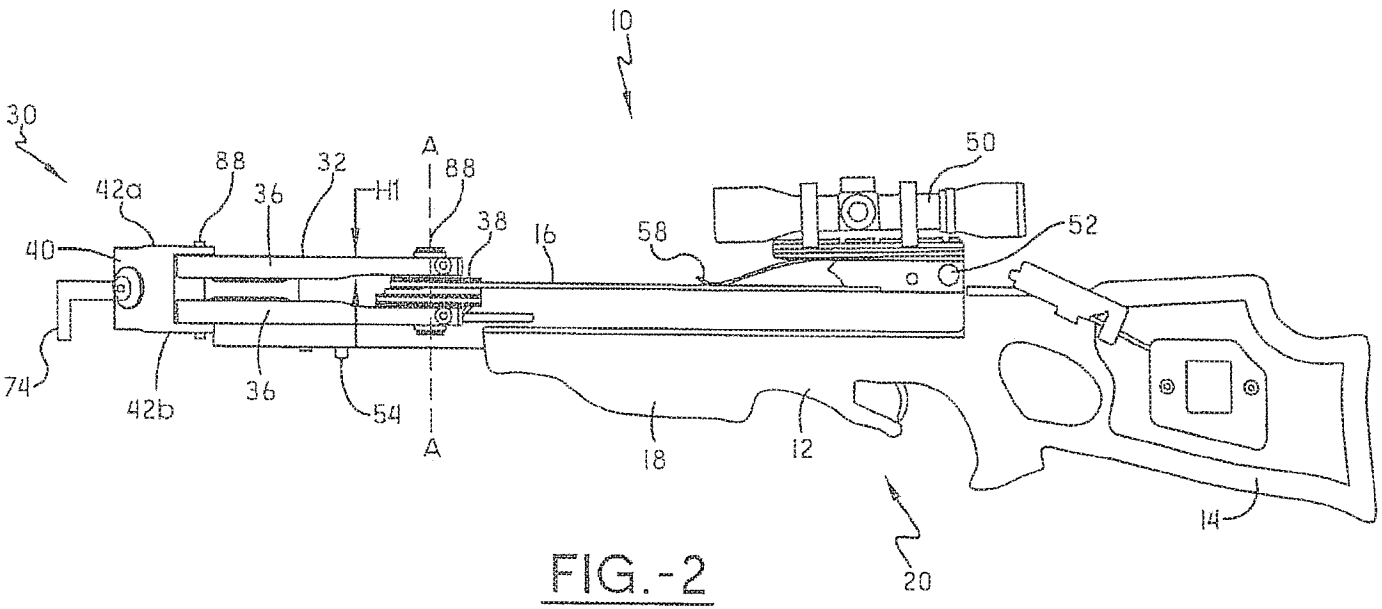
FIG. 2 is a side view of a crossbow similar to that shown in FIG. 1.
Figure 3:
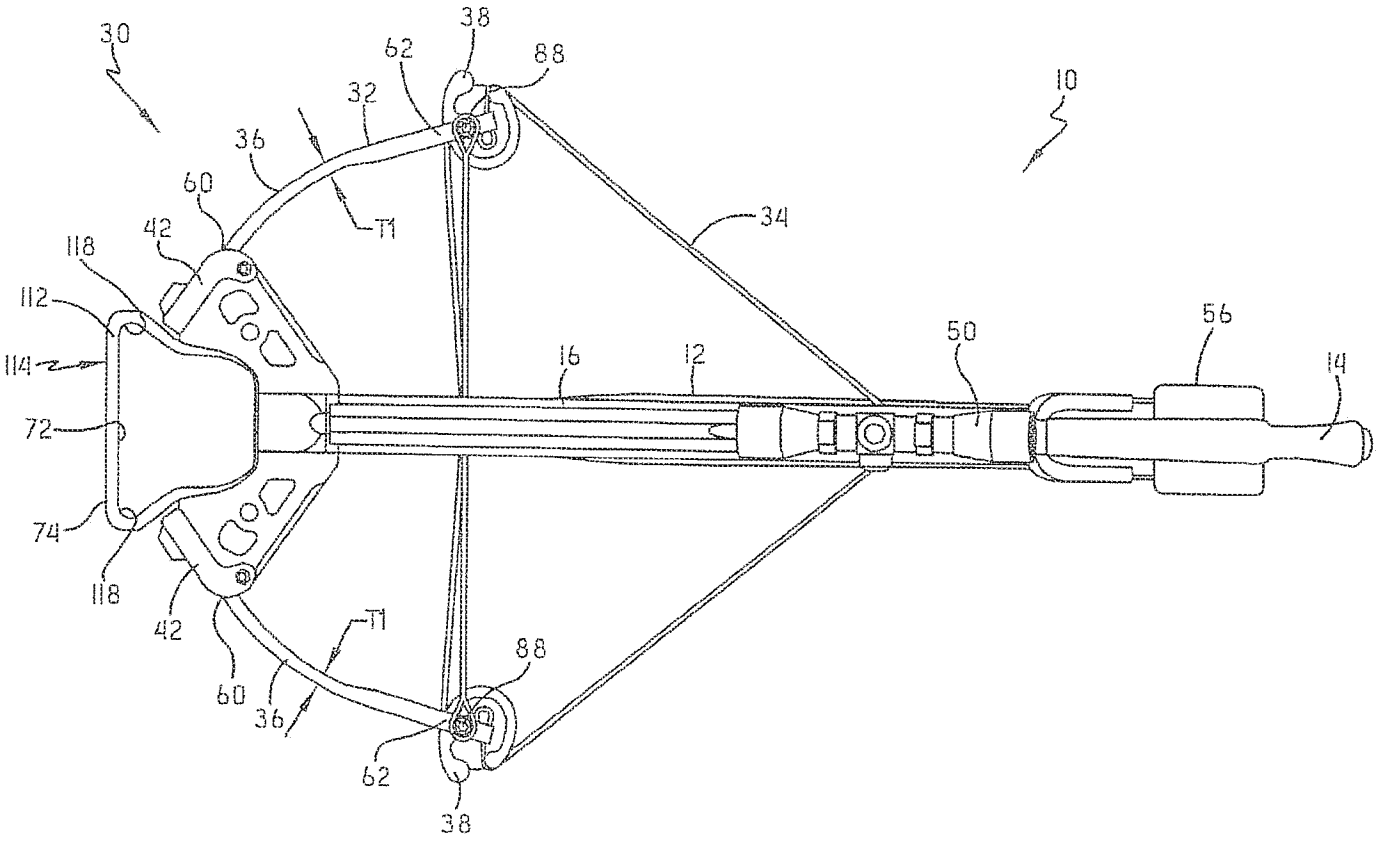
FIG. 3 is a top view of the crossbow of FIG. 2, showing the crossbow in the cocked condition.
Figure 4:
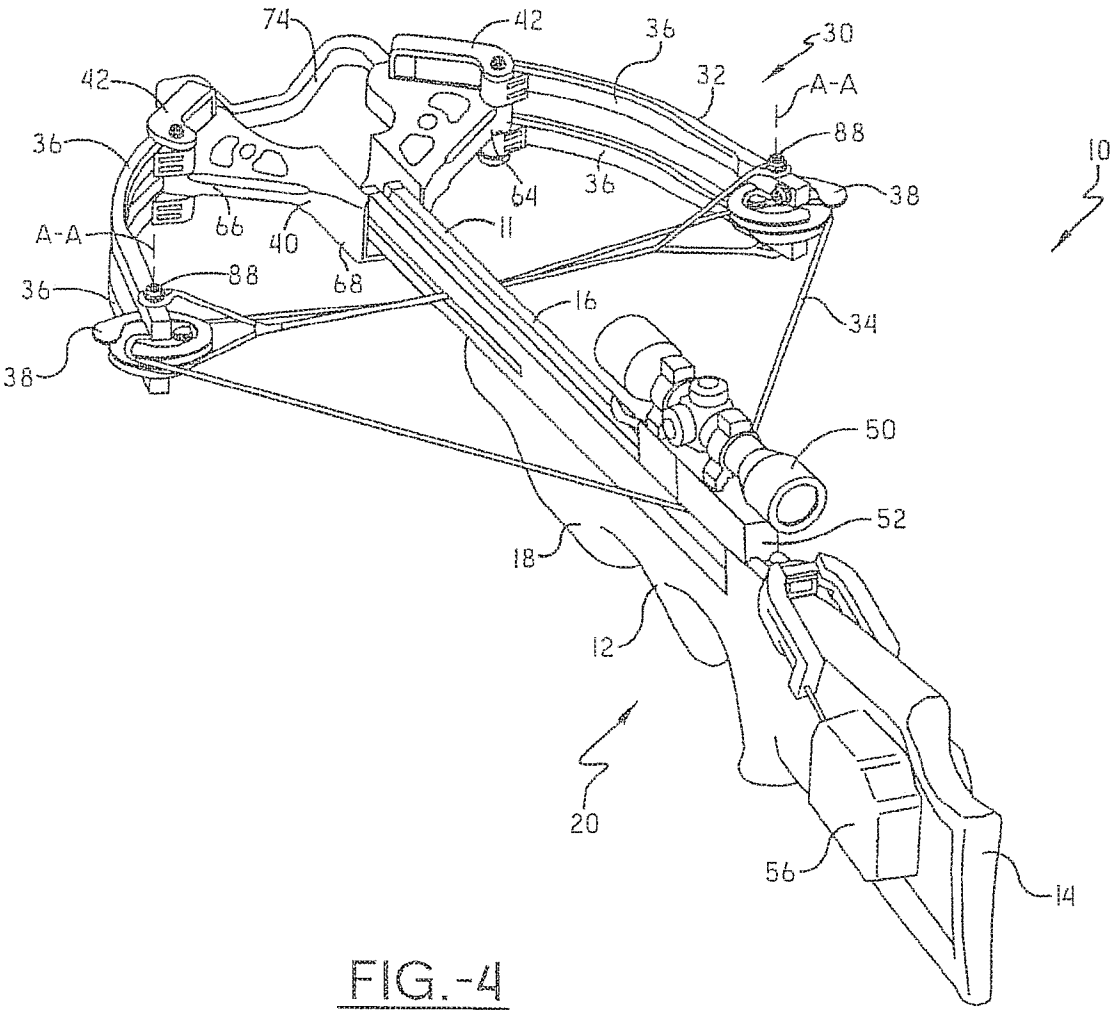
FIG. 4 is a perspective end view of the crossbow shown in FIG. 3.

FIG. 1 shows the crossbow 10 in an uncocked condition while FIGS. 2-4 show the crossbow 10 in a cocked condition. The power stroke is thus shown, in FIG. 1, with reference PD. For this invention the power stroke PD is at least 10 inches. In a more specific embodiment the power stroke PD is at least 12 inches. In yet a more specific embodiment the power stroke PD is about 13 inches. With reference to FIGS. 2 and 4, each wheel 38, 38 pivots about a pivot axis A-A. When the crossbow 10 is in the uncocked condition, the distance between the two pivot axes is shown with reference WD, see FIG. 1. To illustrate the relative narrow design of the crossbow according to this invention, in one embodiment the ratio WD/PD is less than 2.0. In a more specific embodiment the ratio WD/PD is less than 1.8. In getting more specific embodiments the ratio WD/PD is less than 1.6.

With reference now to FIGS. 1-6, a limb design according to one embodiment of this invention will now be described. Each limb 36 has a first end 60 that is received within the corresponding pocket 42 and a second end 62 that is operatively connected to the bowstring 34. Each limb 36 also has, as seen the best in FIG. 6, a length L1, a height H1 (measured from bottom to top when the crossbow is held in the normal operating position), and a thickness T1. Each limb 36 also has a hinge point HP which is the point along the length L1 at which the thickness T1 is at a minimum. It should be noted that the thickness T1 of the limb 36 according to one embodiment varies continuously along its length L1 from the first end 60 to the hinge point HP. This is believed to be a first in the industry as known limbs maintain a constant thickness for at least a portion (2 to 4 inches, for a non-limiting example) of the pocket engaging end. Applicants have discovered, however, that the use of a varied thickness at the first end limb provides unexpected advantages. Specifically, the varied thickness provides limbs that can withstand greater bending forces prior to failing under load and reduced vibrations. The position of the hinge point HP to respect to the first end 60 of the limb 36 can be any position chosen with sound judgment by a person of ordinary skill in the art. In one embodiment, shown in FIG. 6, the hinge point HP is at least 6 inches from the first end 60 of the limb 36. It should also be noted that the pockets 42 were not modified. Thus, it is clear that the varied thickness limbs provide the advantage. As a result, the limb length L1 can be shorter than previously thought possible. This also may contribute to the reduced ratio WD/PD described above. In one embodiment, the limb length L1 may be less than 15 inches. In a more specific embodiment, the limb length L1 may be less than 13 inches. In yet a more specific embodiment, shown in FIG. 6, the limb length L1 maybe about 12 inches. In yet a more specific embodiment, the limb length L1 maybe about 11 inches, the distance between the two pivot axis WD may be about 17.5 inches uncocked and about 13 inches when cocked. For this embodiment, the power stroke distance PD may be about 12 inches or greater.

With continued reference now to FIGS. 1-6, each limb 36 may substantially completely comprise a composite carbon fiber. The composite carbon fiber may provide each limb 36, and therefore the crossbow 10, with a reduced weight. In one embodiment, the composite carbon fiber limb 36 may have a reduced weight relative to a conventional limb thereby resulting in a lighter weight crossbow. The composite carbon fiber limb 36 may also cause a greater attenuation of sound and vibration when firing the crossbow 10. Each composite carbon fiber limb 36 may be pre-engineered and may consist at least partially of actual carbon fibers. Each composite carbon fiber limb 36 may include a decorative design applied thereon. The decorative design may comprise a camouflage pattern that at least partially provides a camouflaged appearance to the crossbow 10 that at increases the user's ability to remain undetected while hunting game, such as, for example, deer. In one embodiment, the decorative design may comprise an epoxy outer layer that is applied over each composite carbon fiber limb 36 during the manufacturing process. In another embodiment, the decorative design may be painted onto the limbs 36 using other methods known in the art.

Figure 5:
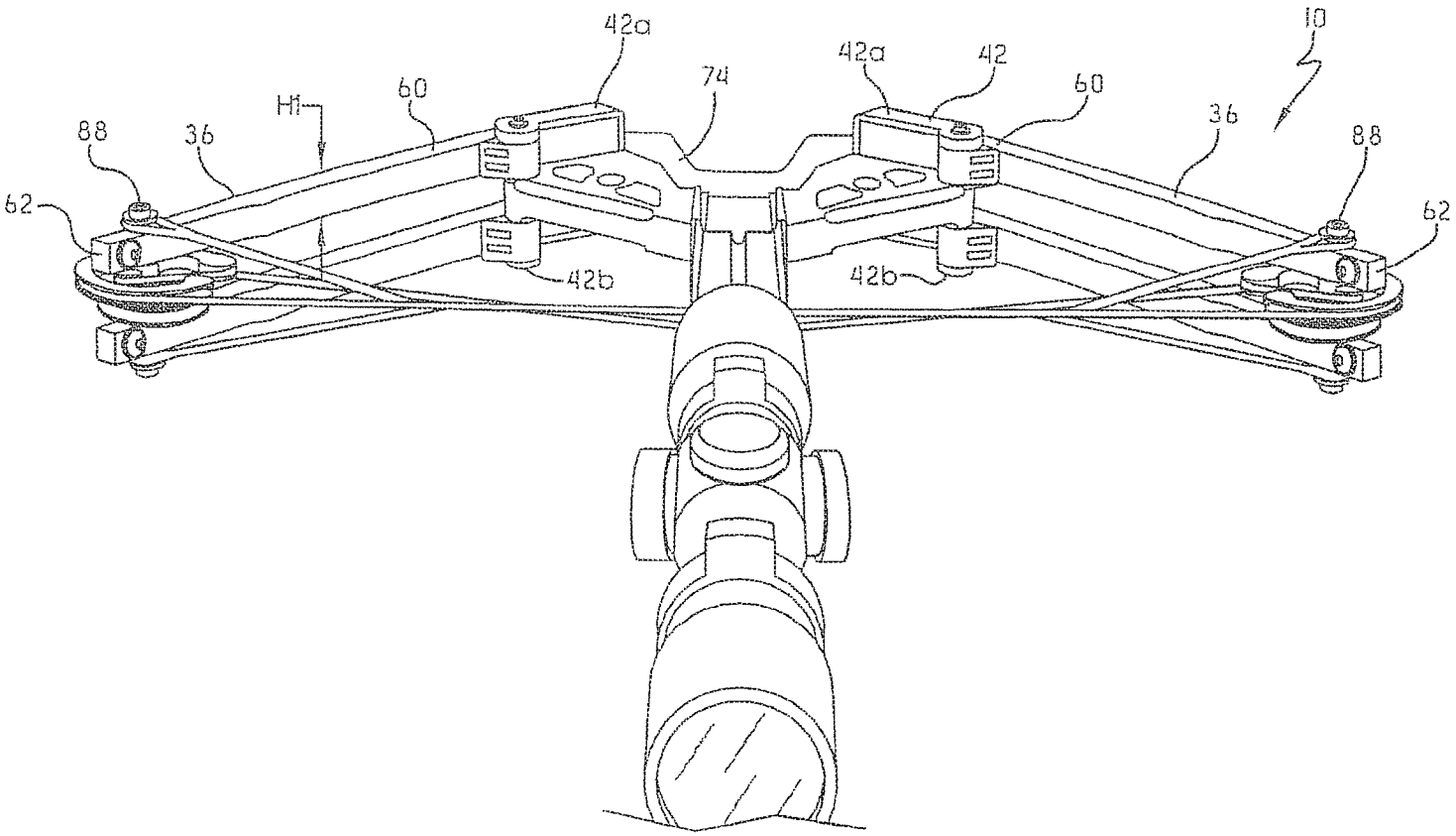
FIG. 5 is a perspective end view of a portion of the crossbow showing the compound bow.
Figure 6:
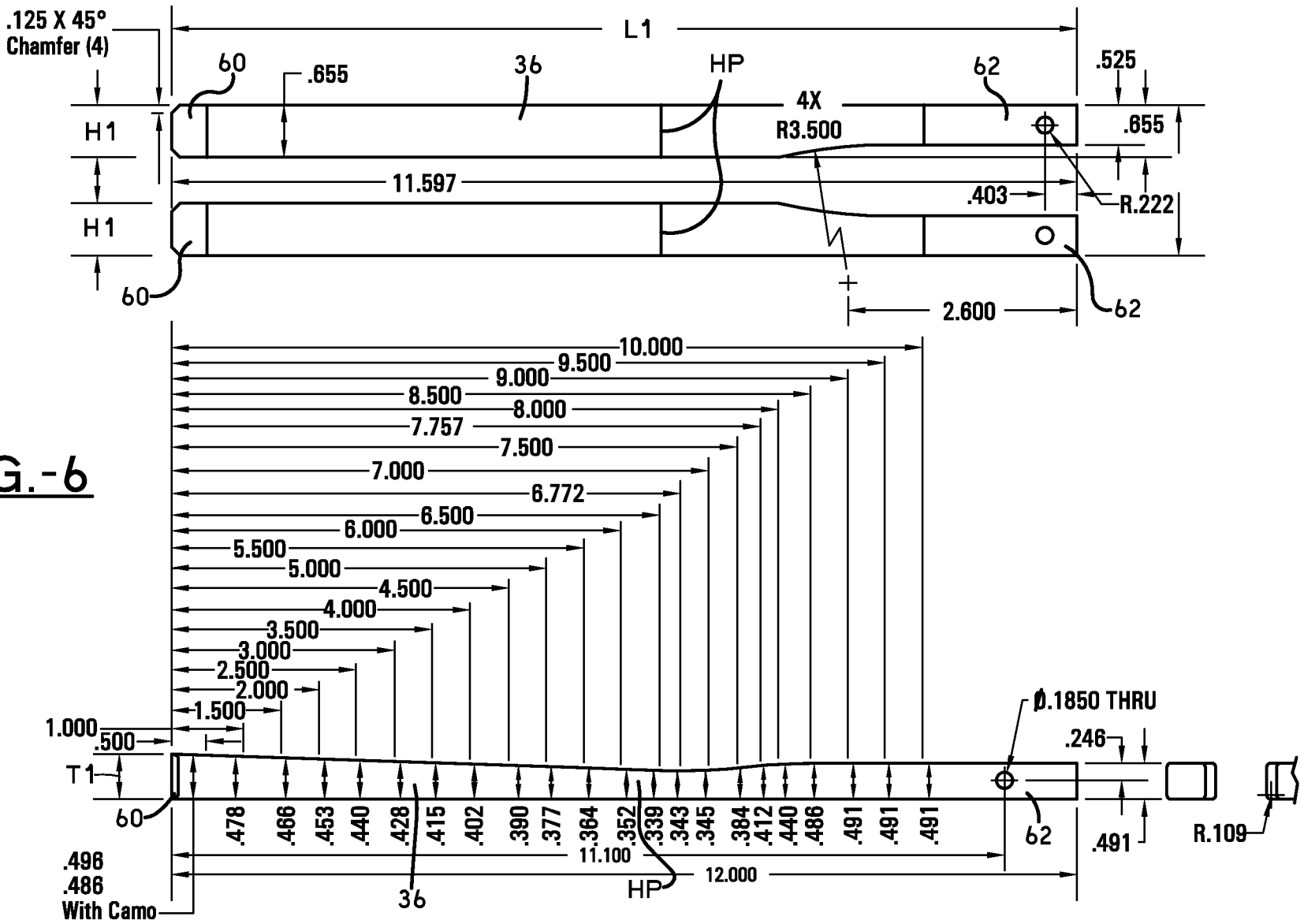
FIG. 6 shows limb dimensions according to one embodiment of this invention.
Figure 7:
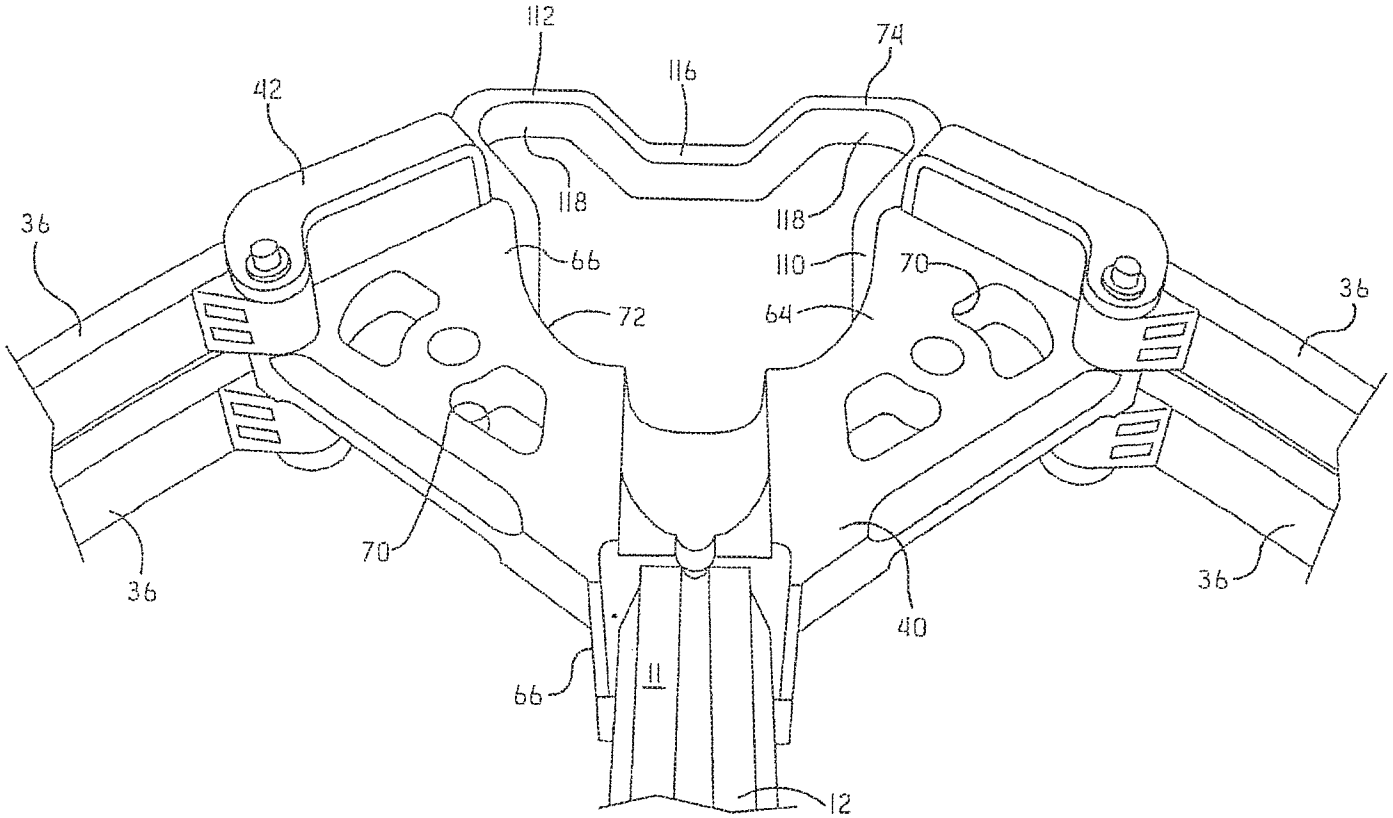
FIG. 7 is a close-up top perspective view of a riser according to one embodiment of this invention.

With reference now to FIGS. 2 and 5, in another embodiment each pocket 42 has first and second portions 42*a*, 42*b*. Each of these portions 42*a*, 42*b* receives a separate limb 36. In this way, the crossbow 10 may use dual limbs on each end of the riser 40. It should be noted that these inventive limb designs are not only applicable to a crossbow but would also apply to a compound bow or other bows when applied with sound judgment by a person of ordinary skill in the art.

With reference now to FIGS. 1-4 and 7-12, a riser design according to one embodiment will now be described. The riser 40 may have a first end 64 with one pocket 42 and a second end 66 with another pocket 42. The riser 40 may also include a connection portion 68 for use in connecting the riser 40 to the first end 11 of the main beam 12. The connection portion 68 may be connected to the main beam 12 in any manner chosen with sound judgment by a person of ordinary skill in the art, such as, for example, using bolts. The riser 40 may include one or more cutouts 70 in order to minimize the riser materials required while still providing sufficient strength. In one embodiment, the riser 40 may substantially completely comprise a composite carbon fiber. The composite carbon fiber may provide the riser 40, and therefore the crossbow 10, with a reduced weight. The composite carbon fiber of the riser 40 may also cause a greater attenuation of sound and vibration when firing the crossbow 10. The composite carbon fiber riser 40 may be pre-engineered and may consist at least partially of actual carbon fibers. The composite carbon fiber riser 40 may include a decorative design applied thereon. The decorative design may comprise a camouflage pattern that at least partially provides a camouflaged appearance to the crossbow 10 that at increases the user's ability to remain undetected while hunting game, such as, for example, deer. In one embodiment, the decorative design may comprise an epoxy outer layer that is applied over the composite carbon fiber riser 40 during the manufacturing process. In another embodiment, the decorative design may be painted onto the composite carbon fiber riser 40 using other methods known in the art.

Figure 8:
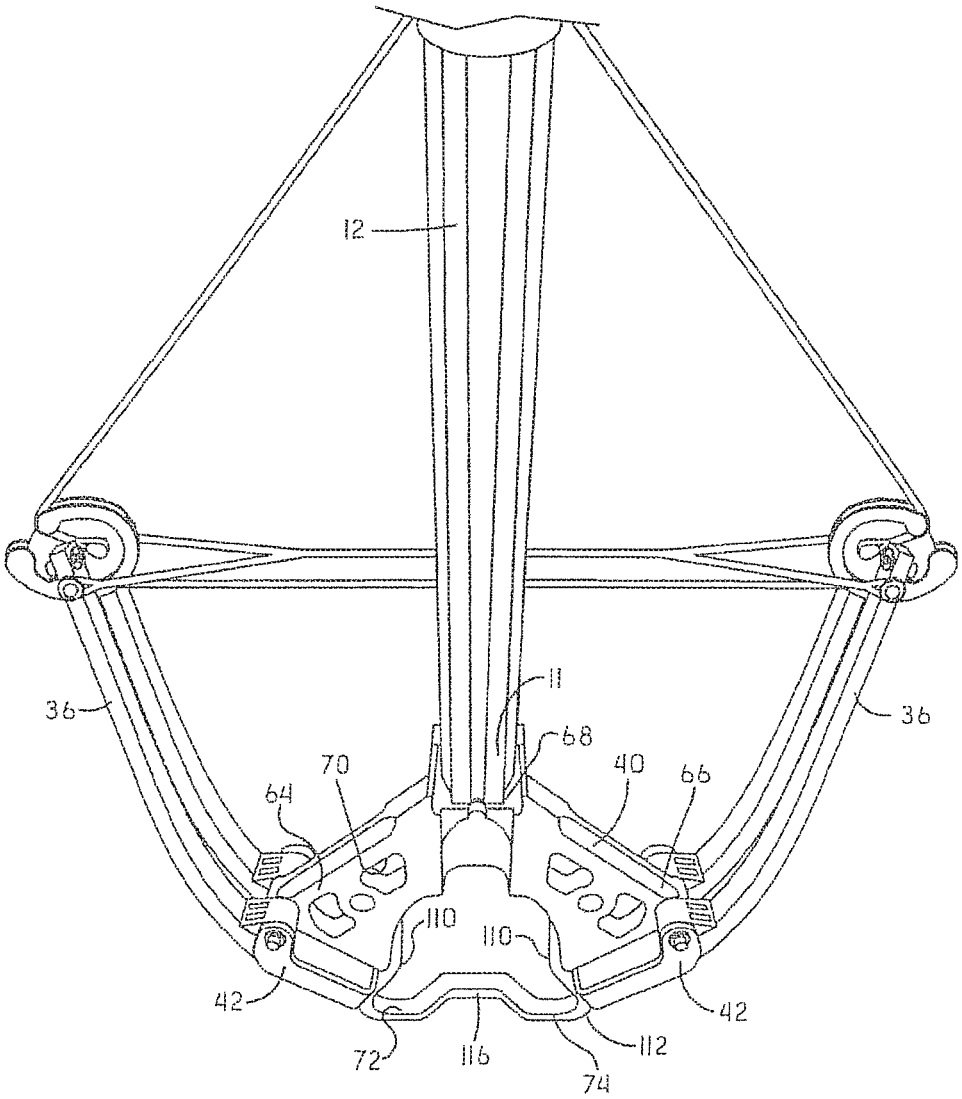
FIG. 8 is a perspective view of a crossbow showing how a foot stirrup may engage a ground surface.
Figure 9:
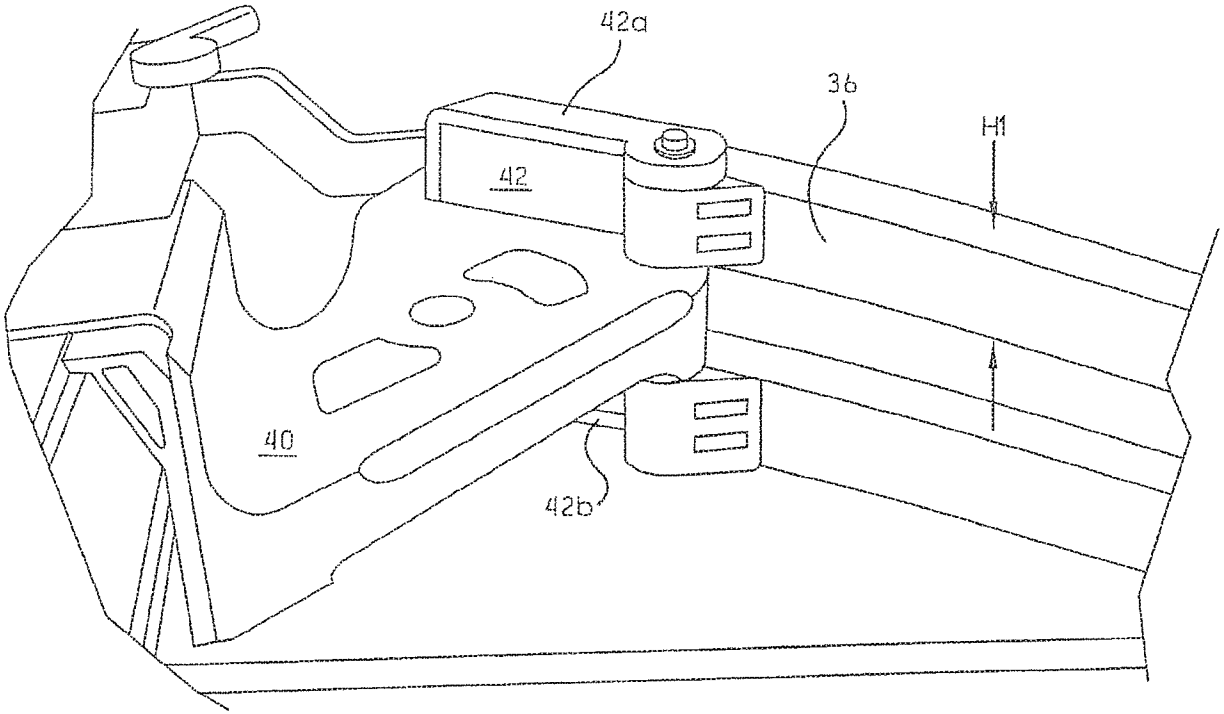
FIG. 9 is a close-up top perspective view showing how the bow limbs may be received within riser pockets according to one embodiment of this invention.
Figure 10:
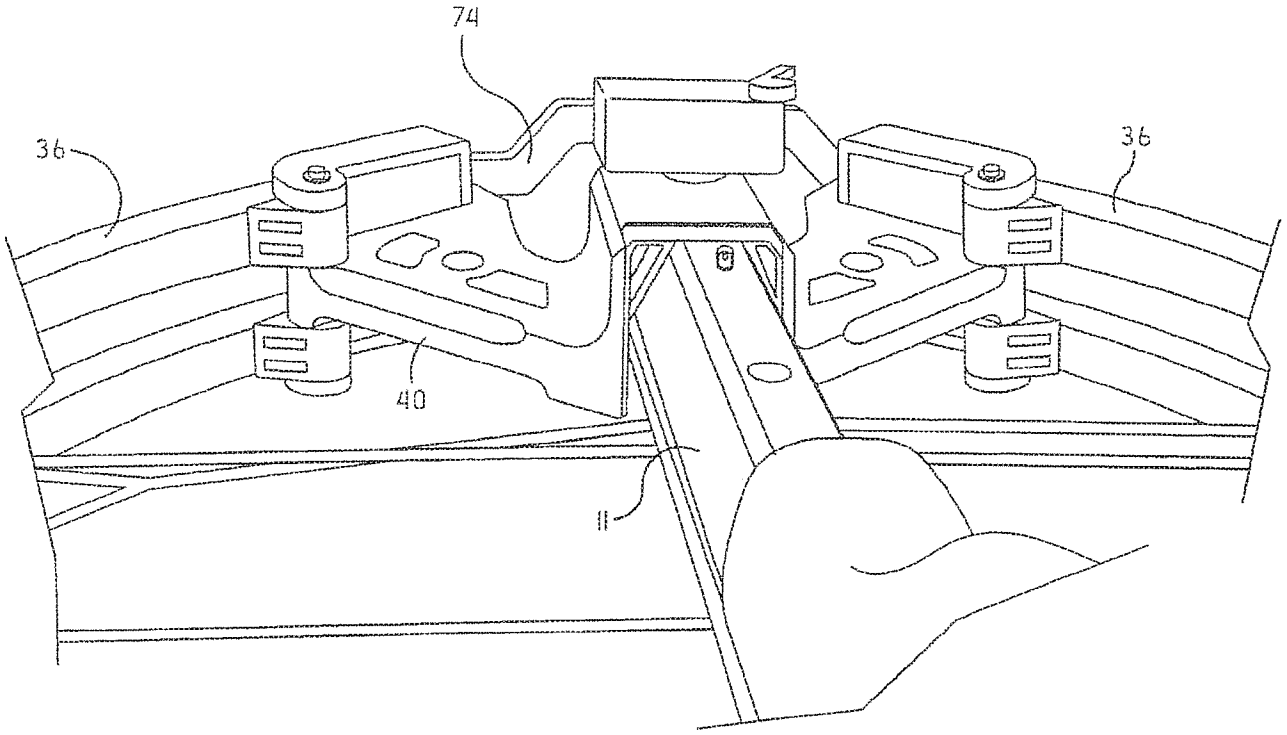
FIG. 10 is a close-up top perspective view showing how the riser may be connected to the main beam according to one embodiment of this invention.
Figure 11:
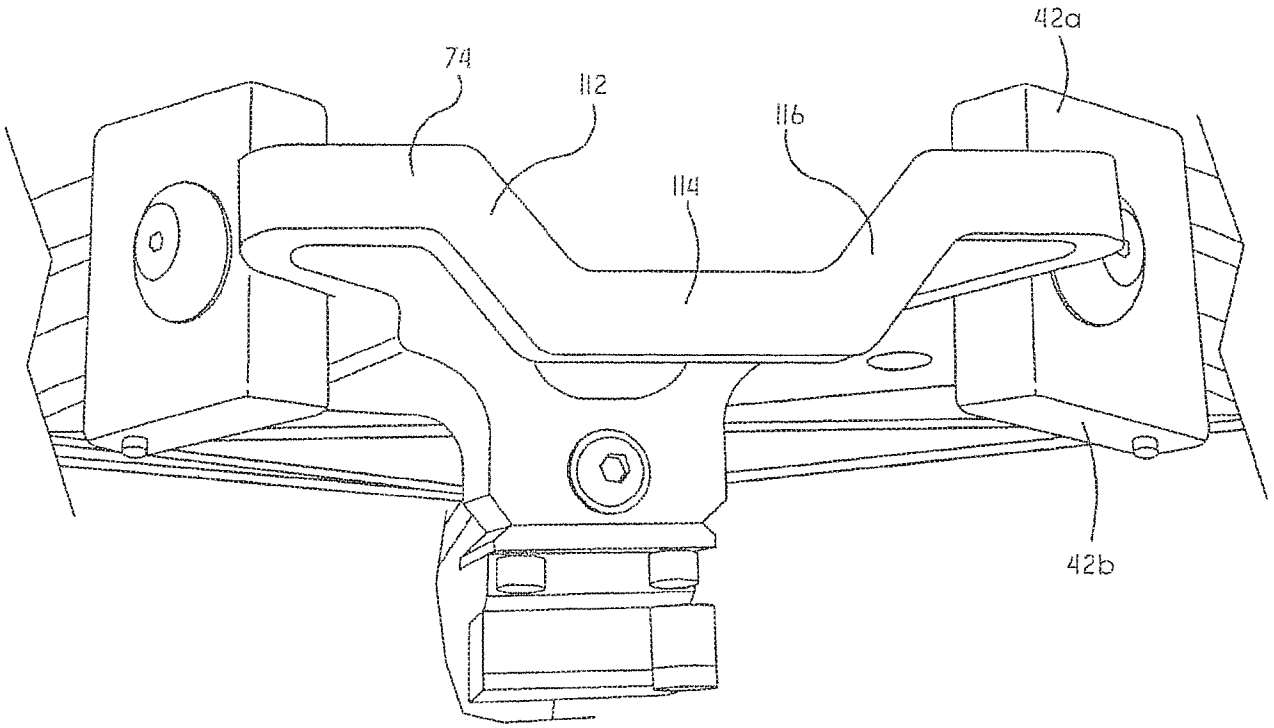
FIG. 11 is a close-up end view of the riser shown in FIG. 10.
Figure 12:
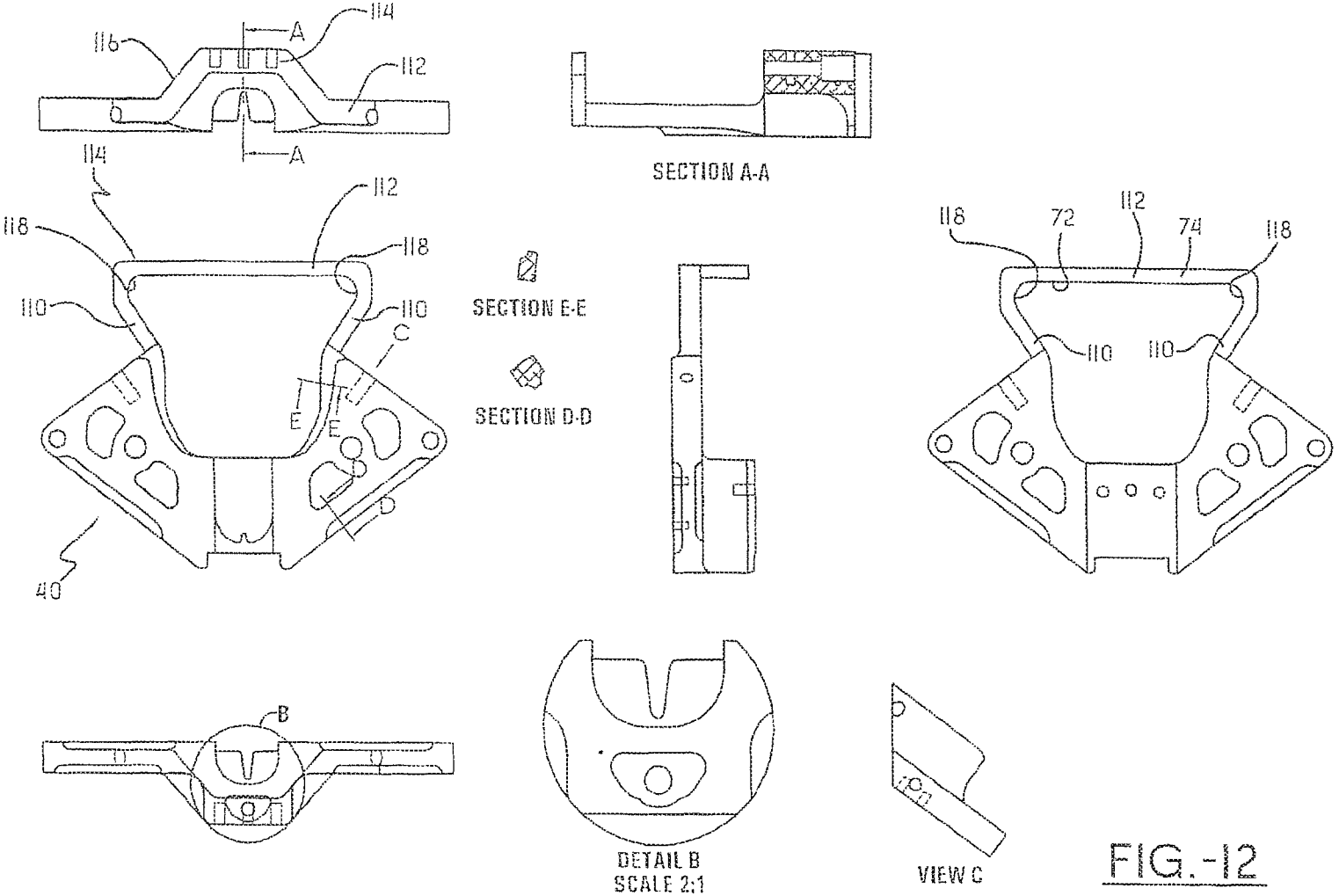
FIG. 12 shows various riser views and dimensions according to one embodiment of this invention.
Figure 13:
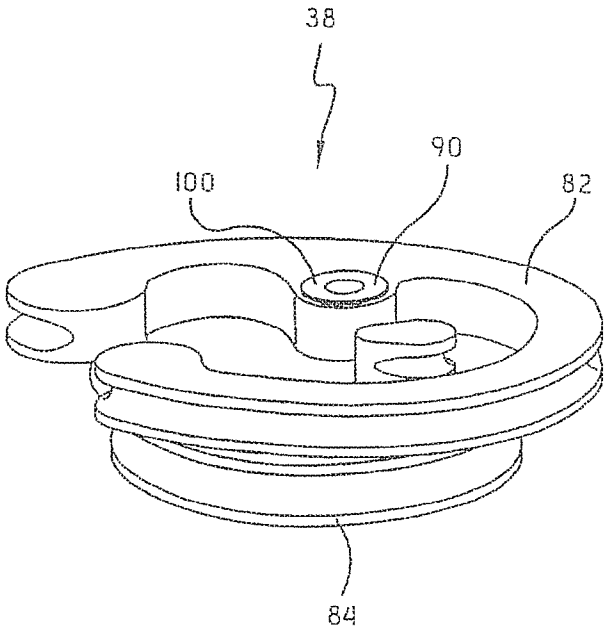
FIG. 13 is a perspective side view of two wheels according to one embodiment of this invention.
Figure 13:
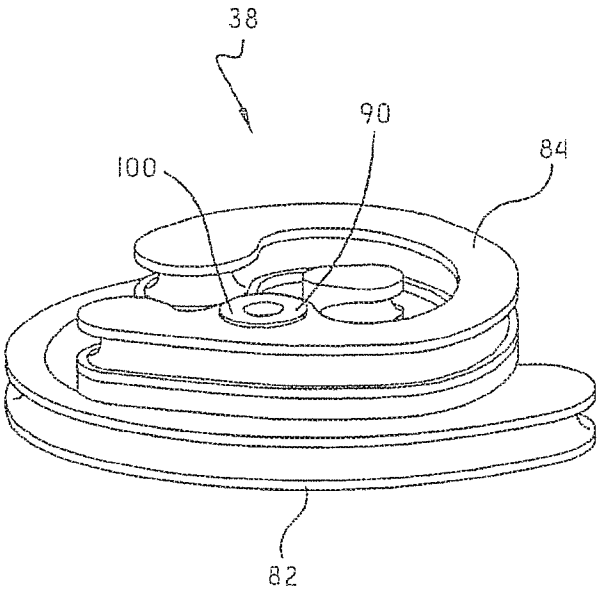
Figure 14:
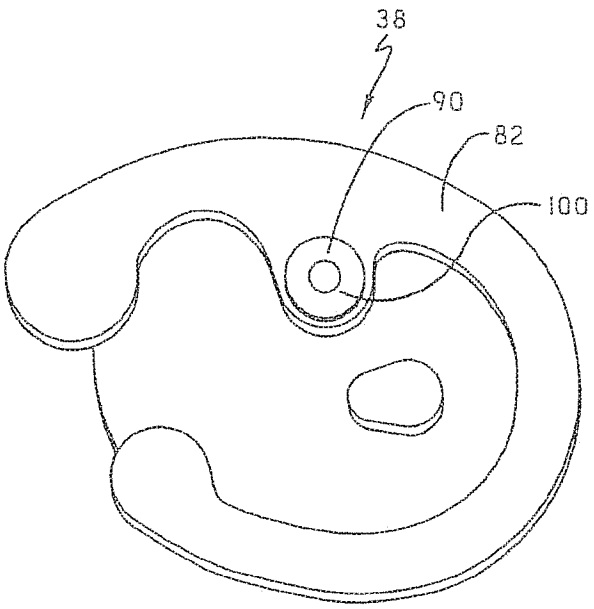
FIG. 14 is a top view of the wheels shown in FIG. 13.
Figure 14:
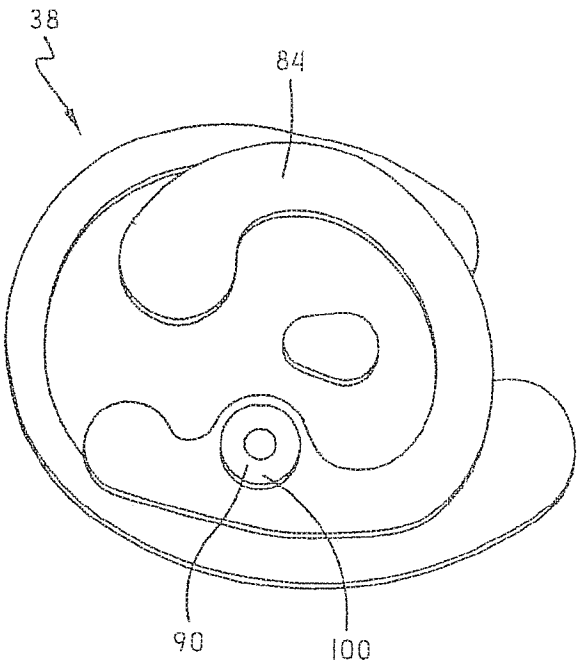
Figure 15:
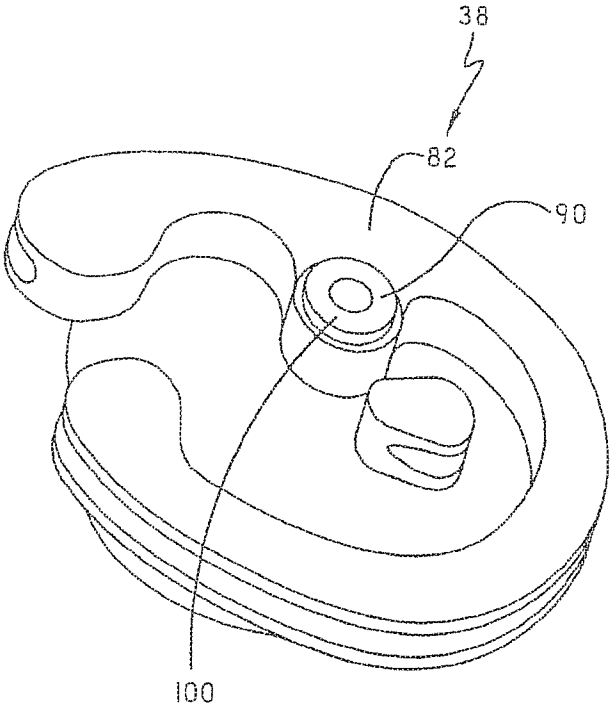
FIG. 15 is a perspective top view wheels shown in FIG. 13.
Figure 15:
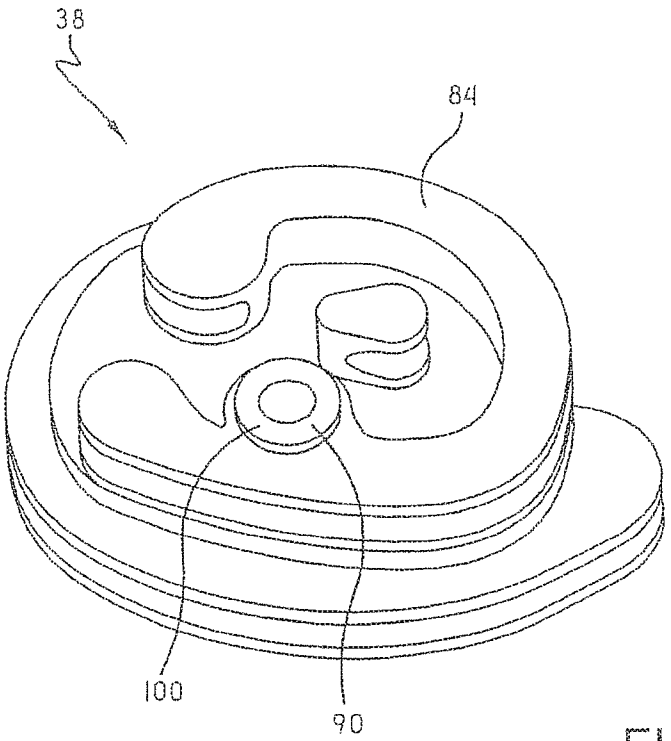
Figure 16:
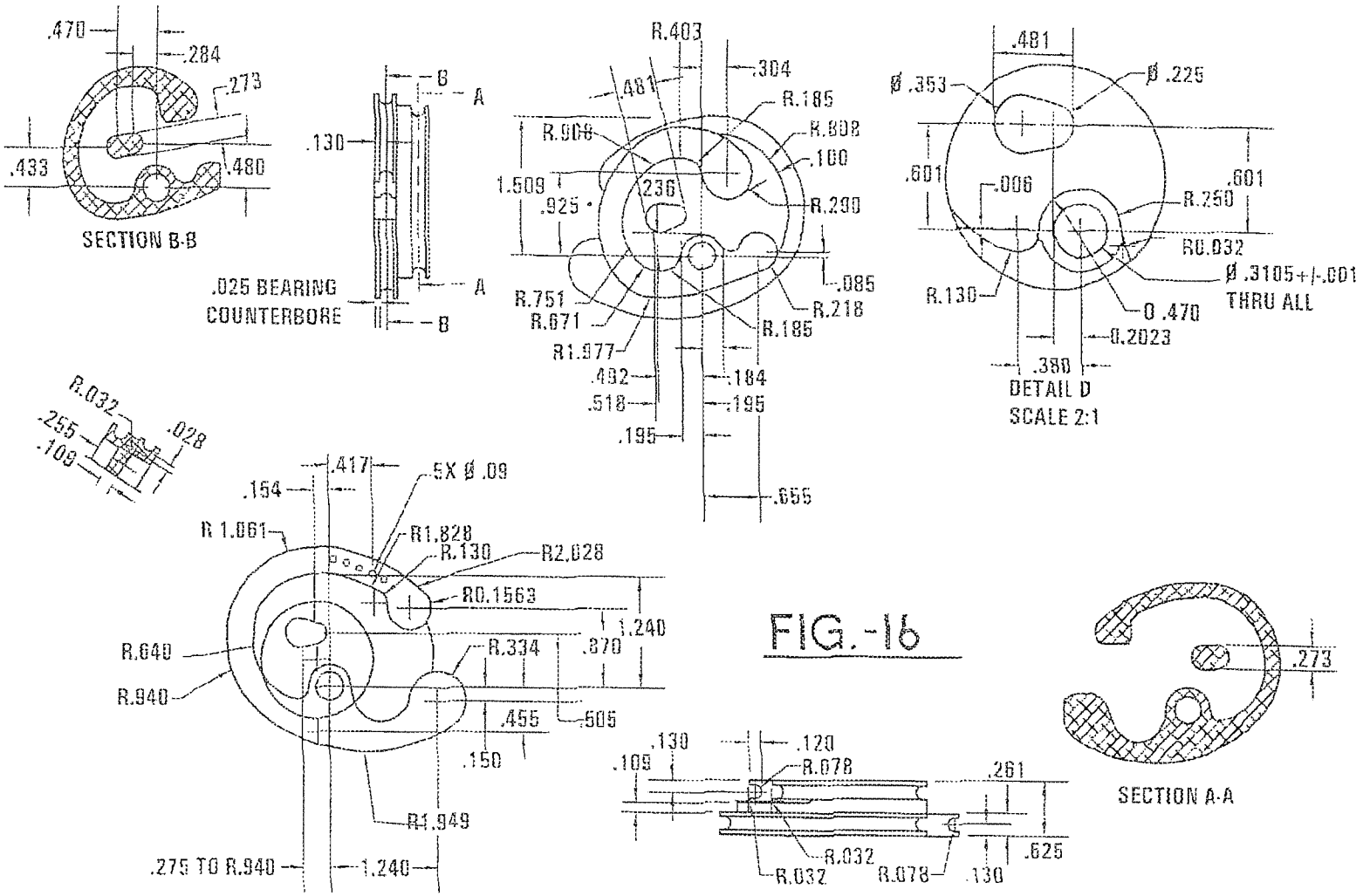
FIG. 16 shows various wheel views and dimensions according to one embodiment of this invention.
Figure 17:
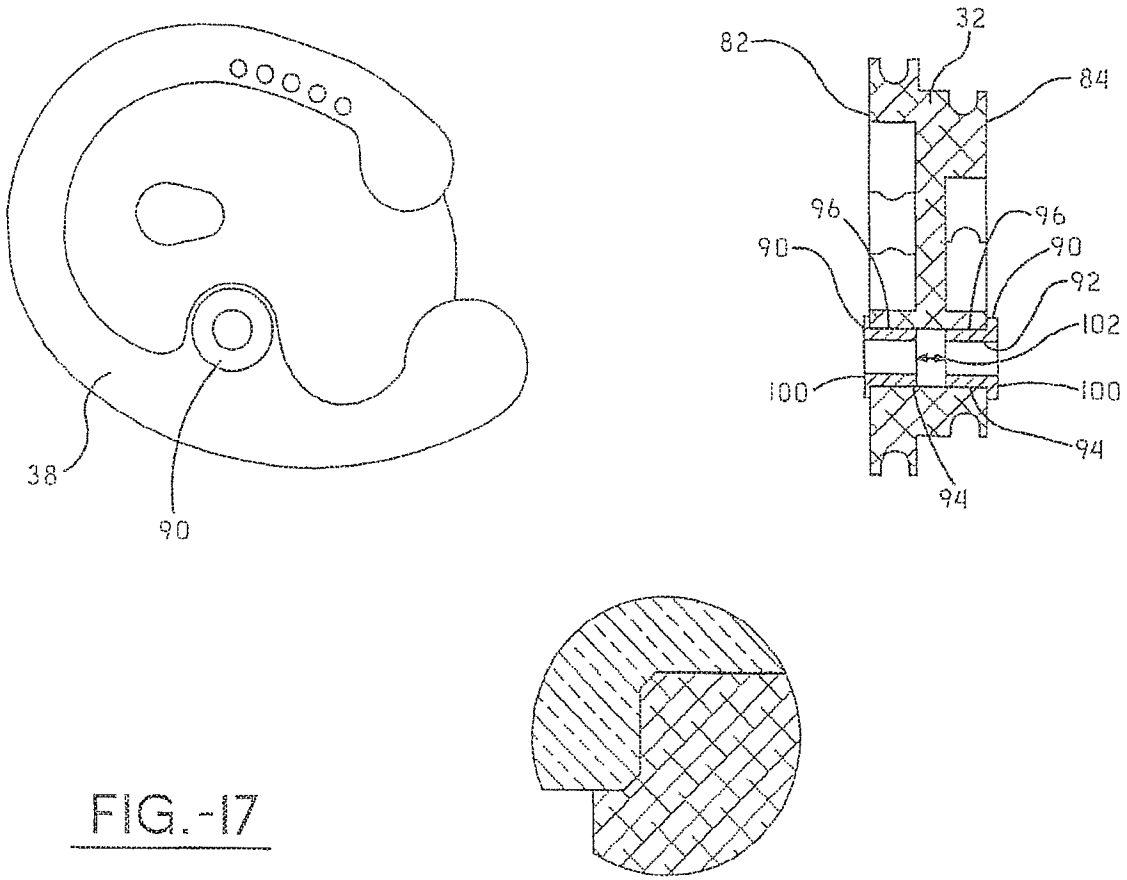
FIG. 17 illustrates how bushings may be positioned within one of the pulley wheels according to one embodiment of this invention.
Figure 18:
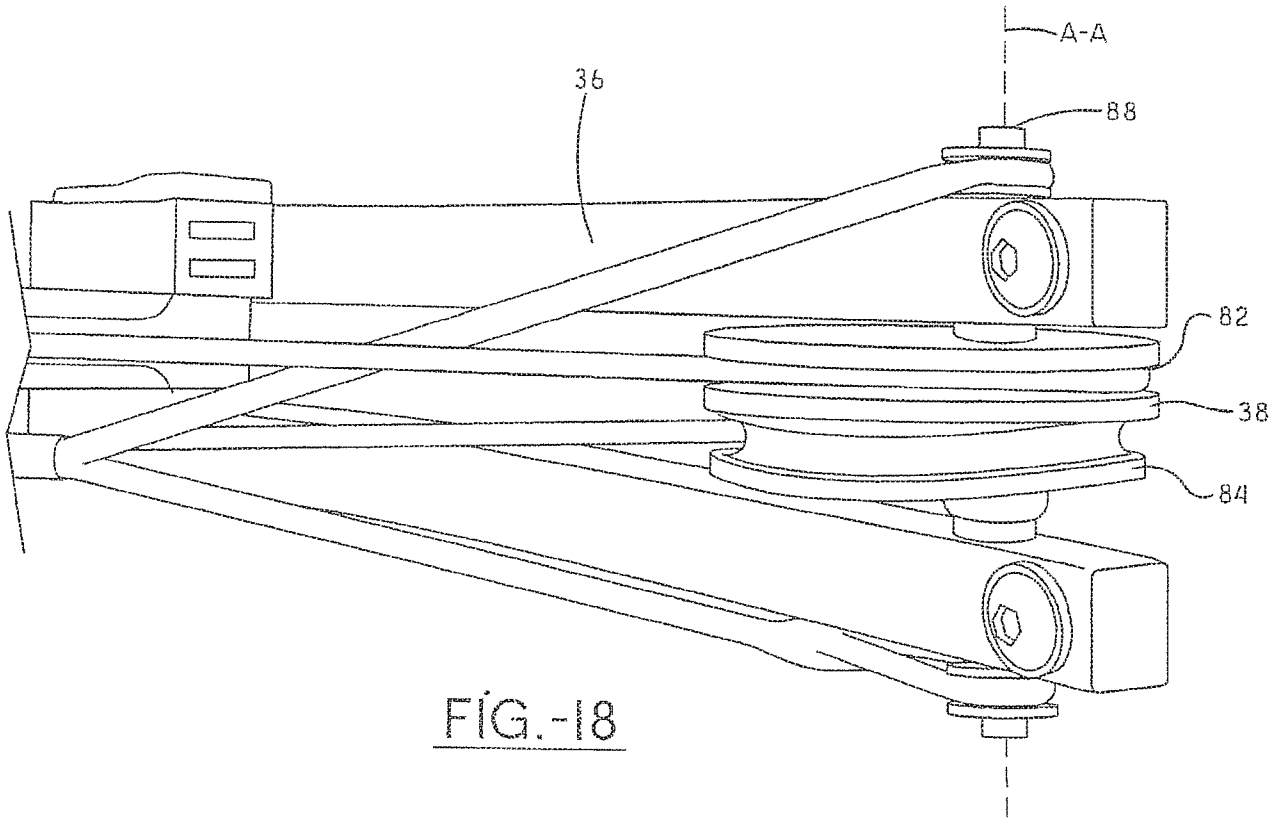
FIG. 18 is a close-up perspective view showing how a wheel may be attached to the crossbow limbs and to the bowstring.
Figure 19:
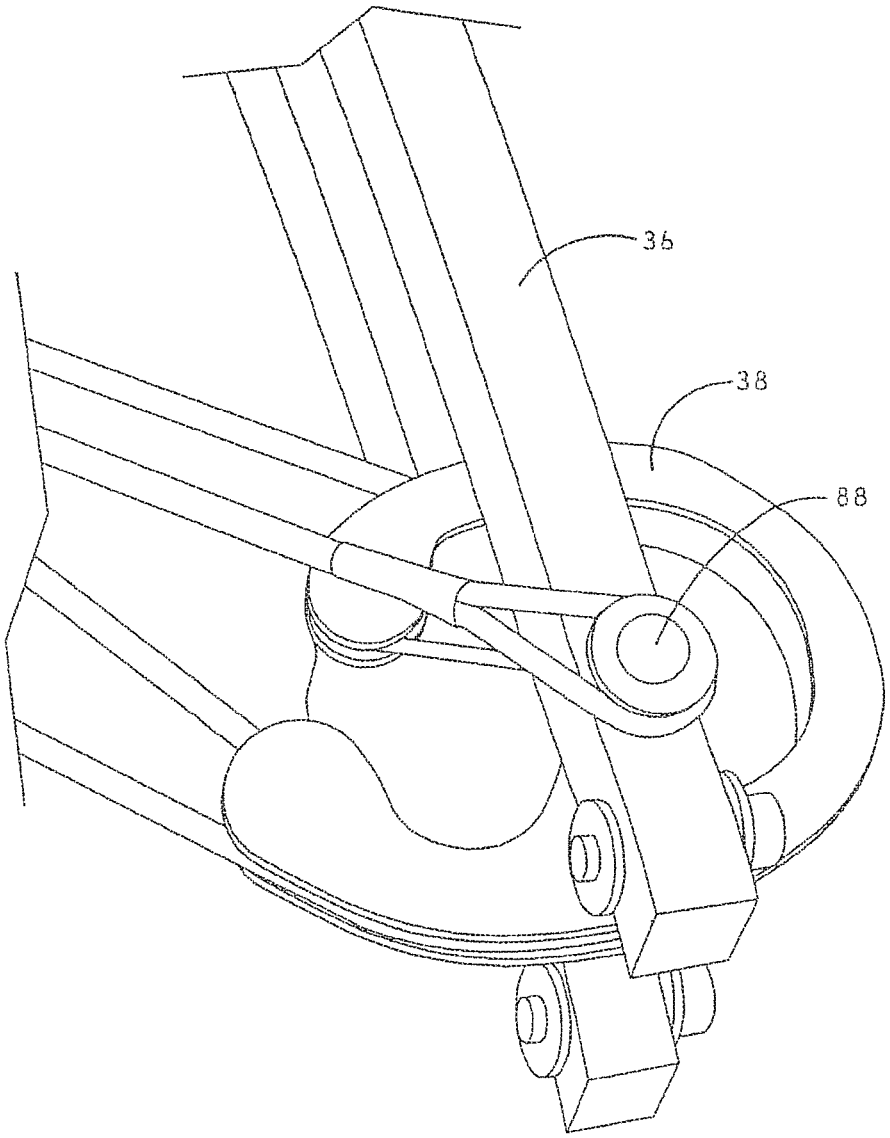
FIG. 19 is a top view of the wheels shown in FIG. 18.
Figure 20:
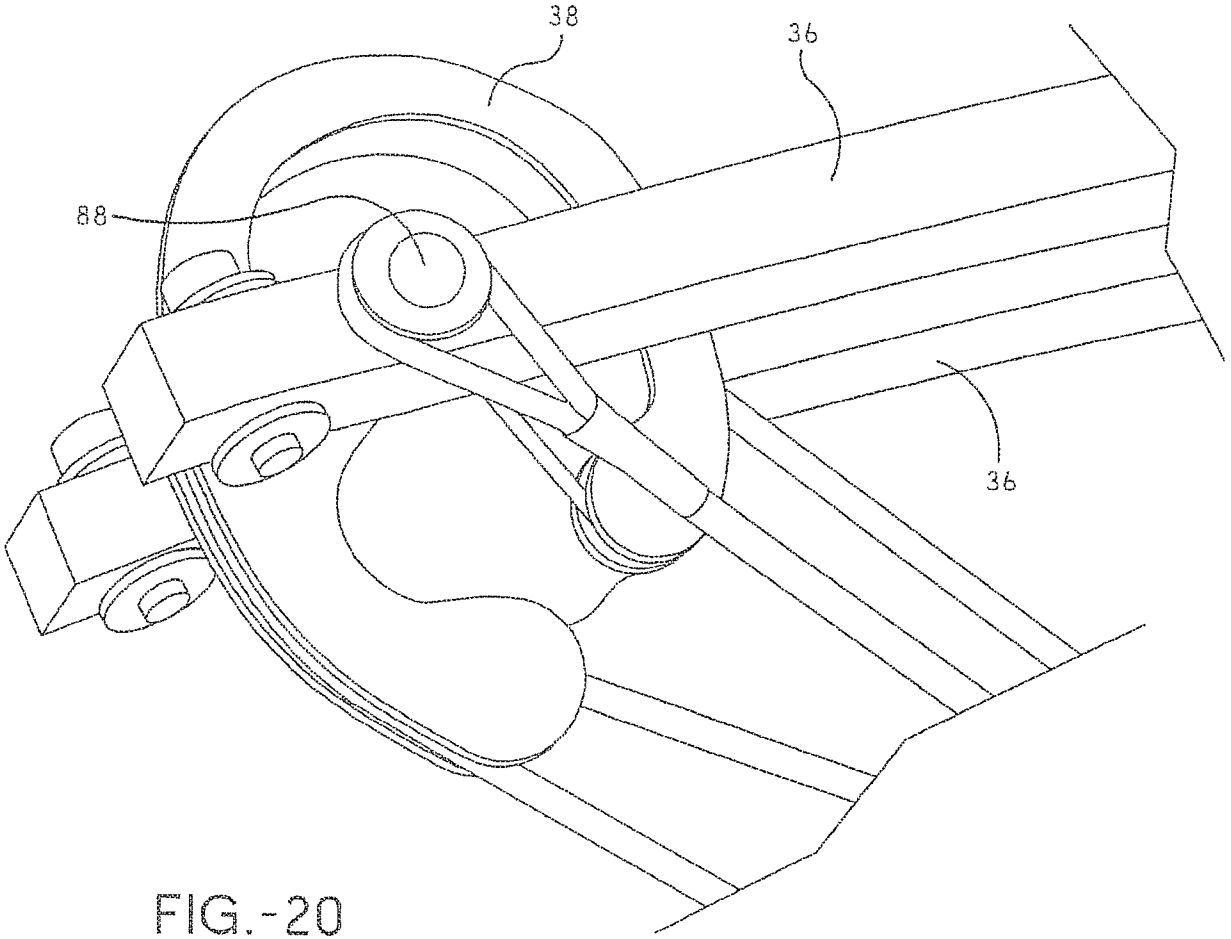
FIG. 20 is a top view of another wheel attached to crossbow limbs and to the bowstring.

With continued reference now to FIGS. 1-4 and 7-12, an opening 72 may be formed in the riser 40 and may define a foot stirrup 74 which is used, as is well known, in cocking the crossbow 10. In one embodiment, the opening 72 is positioned at least partially directly between the pockets 42, 42. This arrangement provides an opening 72 sufficient to receive most boot sizes yet simultaneously provides a reduced overall length for the crossbow 10 making it easier to manually cock the bowstring 34. In another embodiment, the pockets 42, 42 extend at least partially longitudinally beyond the first end of 11 off the main beam 12. This arrangement also provides for an overall reduced length for the crossbow 10. In yet another embodiment, the foot stirrup 74 is made with the riser 40 as a single piece. This permits, for one non-limiting example, the riser 40 and the foot stirrup 74 to be machined from a single piece of material. In one embodiment, the foot stirrup 74 comprises a generally U-shaped member extending from the riser body. The U-shaped member has a pair of leg portions 110, 110 and a mid-portion 112. The mid-portion 112 has an outer surface 114 that is substantially planar and is used in contacting a ground surface (as shown in FIG. 8) when cocking the crossbow 10. The mid-portion 112 in one embodiment is on the same plane as the leg portions 110, 110. In another embodiment, shown, the mid-portion 112 has an offset 116. This offset 116 permits the crossbow 10 to be easily balanced on a ground surface when a user is cocking the crossbow 10. As shown in FIGS. 11-12, the offset 116 may extend downwardly. In one embodiment, the leg portions 110, 110 extend substantially perpendicular from an inner surface of the mid-portion 112. In another embodiment, shown in FIG. 12, each leg portion 110 has an offset 118 that may extend outwardly. This offset 118 permits the opening 72 to be larger to thereby receive a user's foot that is larger and also provides for a longer mid-portion 112 that assists in balancing the crossbow 10 to a ground surface. It should be noted that this inventive riser design is not only applicable to a crossbow having a compound bow but also to a crossbow having other bows when applied with sound judgment by a person of ordinary skill in the art.

With reference now to FIGS. 1-4 and 13-20, a wheel design according to one embodiment will now be described. The wheel 38 may have first and second sides 82, 84 and an opening 86 (referenced in FIG. 16). The opening 86 is used to receive a shaft 88 that is operatively connected to the limbs 36 of the crossbow 10. The wheel 38 may then rotate about the shaft 88 any manner chosen with sound judgment by a person of ordinary skill in the art. Rather than having the wheel opening 86 rotate directly around the shaft 88 as is commonly known, at least one bushing 90 may be used. The bushing 90, as seen in best in FIG. 17, may have an opening 92 that rotatably receives the shaft 88. The bushing 90 may also have a first end 94 that is received within the opening 86 in the wheel 38 and a second end 96 that has a flange 100. The flange 100 has an outer diameter that is greater than the outer diameter of the first end 94. As a result, the flange 100 contacts the first side 82 of the wheel 38. It is to be understood, however, that the outer shape of the bushing 90 need not be circular in cross-section, as shown, but could have other shapes. In another embodiment, a second bushing 90 may be inserted into the opposite end of the wheel opening 86. In this case, the flange 100 contacts the second side 84 of the wheel 38. In still another embodiment, there is a space 102 between the first end 94 of one bushing 90 and the first end 94 of the other bushing 90 when they are properly installed onto the wheel 38. For the embodiments shown, each wheel 38 comprises a pair of pulleys and comprises a cam. It should be understood, however, that the bushings described herein will work with wheels having any number of pulleys and wheels that may or may not comprise a cam. It should be noted that this inventive wheel design is not only applicable to a crossbow but would also apply to a compound bow when applied with sound judgment by a person of ordinary skill in the art.

Figure 21:
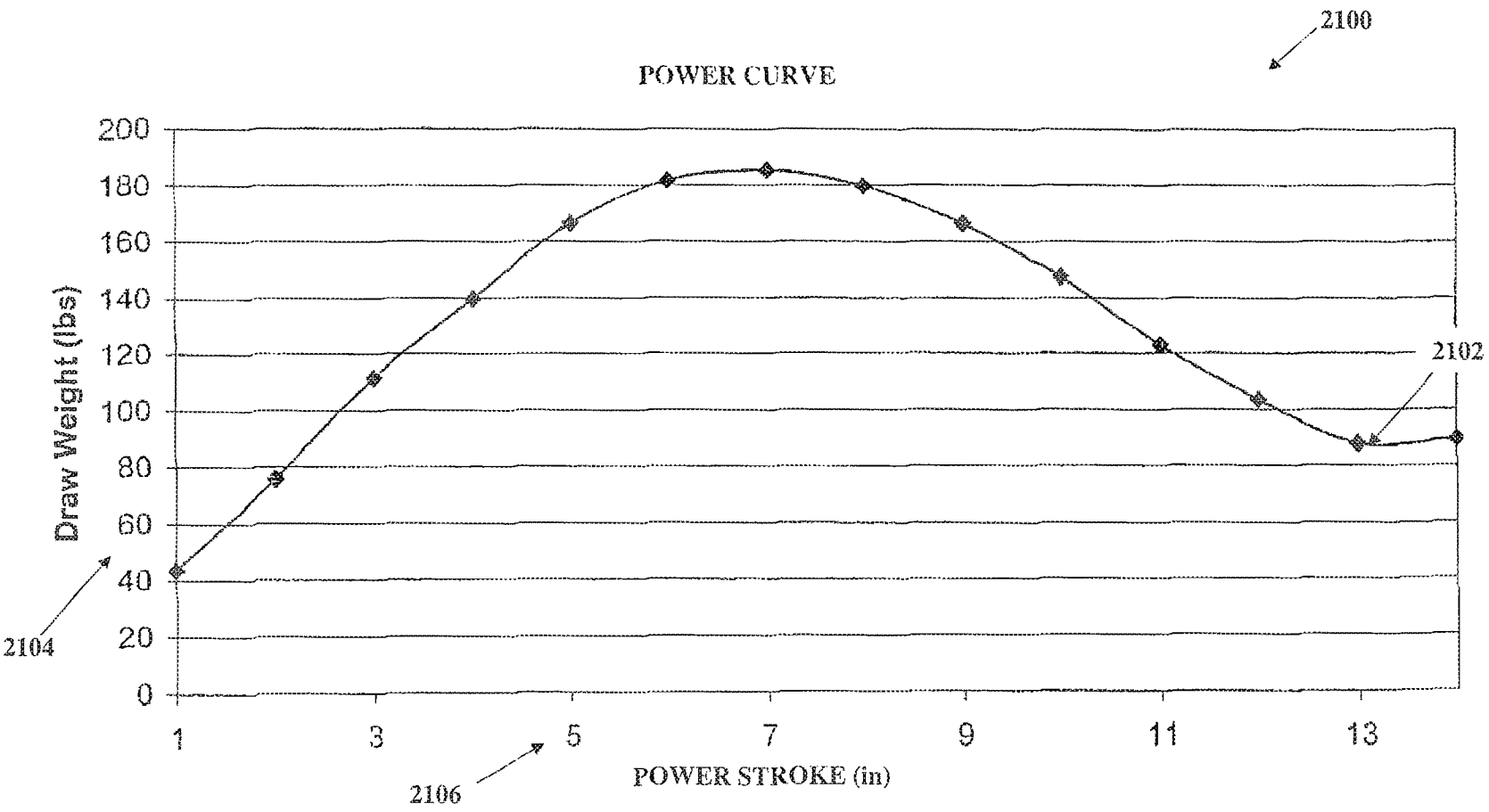
FIG. 21 is a graph of an example draw weight to power stroke line.

FIG. 21 illustrates an example graph 2100 of a crossbow's draw weight to power stroke data, illustrating a resulting power curve 2102. In this example graph 2100, the draw weight of a crossbow is represented by the 'Y' axis 2104 and the power stroke (e.g., power distance (PD)) of the crossbow is represented by the 'X' axis 2106. Further, in this example, the draw weight 2104 comprises units in pounds (lbs), and the power stroke 2106 comprises units in inches (in). As an example, the data used to generate the plot of the power curve 2102 is derived from experimental data for a given crossbow; however, different data may be derived from a different crossbow, such as one comprising different materials and/or configurations. The following table 1 represents the power stroke to draw weight plots indicated by the example graph 2100 for the given crossbow:

TABLE 1

Draw Weight to Power Stroke data.

| Power Stroke (PD) in inches | Draw Weight in pounds |
|---|---|
| 1 | 43.5 |
| 2 | 75.7 |
| 3 | 111.4 |
| 4 | 139.7 |
| 5 | 166.4 |
| 6 | 181.5 |
| 7 | 185 |
| 8 | 179.6 |
| 9 | 166.3 |
| 10 | 147.4 |
| 11 | 122.7 |
| 12 | 103.4 |
| 13 | 87.7 |
| 14 | 89.4 |

Further, when given data regarding power stroke (PD) and data for wheel distance (WD) to PD ratios (WD/PD), a wheel distance for the given data can be calculated as, WD=(PD)(WD/PD). Table 2 below illustrates potential WD values that may be calculated using various combinations of values described above:

TABLE 2

Wheel Distance (WD) values based on known WD/PD ratios and known PD data.

| | PD = 10 | PD = 12 | PD = 13 |
|---|---|---|---|
| WD/PD < 2.0 | WD < 20.0 | WD < 24.0 | WD < 26.0 |
| WD/PD < 1.8 | WD < 18.0 | WD < 21.6 | WD < 23.4 |
| WD/PD < 1.6 | WD < 16.0 | WD < 19.2 | WD < 20.8 |

Based on the forgoing, in one implementation, as illustrated in Table 2, when the WD is less than 26, in any of the example WD/PD ratios, the PD is 13 or less. Further, in this implementation, as illustrated in Table 1, when the PD is 13 the draw weight may be greater than eighty-seven pounds.

The word "exemplary" is used herein to mean serving as an example, instance or illustration. Any aspect or design described herein as "exemplary" is not necessarily to be construed as advantageous over other aspects or designs. Rather, use of the word exemplary is intended to present concepts in a concrete fashion. As used in this application, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Further, at least one of A and B and/or the like generally means A or B or both A and B. In addition, the articles "a" and "an" as used in this application and the appended claims may generally be construed to mean "one or more" unless specified otherwise or clear from context to be directed to a singular form.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. Of course, those skilled in the art will recognize many modifications may be made to this configuration without departing from the scope or spirit of the claimed subject matter.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure.

In addition, while a particular feature of the disclosure may have been disclosed with respect to only one of several implementations, such feature may be combined with one or more other features of the other implementations as may be desired and advantageous for any given or particular application. Furthermore, to the extent that the terms "includes," "having," "has," "with," or variants thereof are used in either the detailed description or the claims, such terms are intended to be inclusive in a manner similar to the term "comprising."

The implementations have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

Having thus described the invention, it is now claimed:

1. A crossbow comprising:

a main beam;

a first bow limb that has: a first end supported to the main beam and a second end opposite the first end;

a second bow limb that has: a first end supported to the main beam and a second end opposite the first end; and a bowstring that is: adapted to propel an arrow, received on the second end of the first bow limb and received on the second end of the second bow limb;

wherein:

(1) the first end of the first bow limb and the first end of the second bow limb are separated such that a minimum distance between them is not greater than about 5 inches; and (2) an opening that is at least as wide as a user's foot extends between the first end of the first bow limb and the first end of the second bow limb.

2. The crossbow of claim 1 wherein:

a first limb pocket receives the first end of the first bow limb; and a second limb pocket receives the first end of the second bow limb.

3. The crossbow of claim 1 wherein:

the first bow limb has a length that is less than or equal to 12 inches; and the second bow limb has a length that is less than or equal to 12 inches.

4. The crossbow of claim 1 wherein:

the first bow limb has a hinge point and a thickness that varies continuously along its length from the first end to the hinge point; and the second bow limb has a hinge point and a thickness that varies continuously along its length from the first end to the hinge point.

5. The crossbow of claim 1 further comprising:

a riser that has: a first limb attachment surface, a second limb attachment surface and a connection portion;

wherein:

(1) the first end of the first bow limb is attached to the first limb attachment surface;

(2) the first end of the second bow limb is attached to the second limb attachment surface; and (3) the connection portion is attached to the main beam.

6. The crossbow of claim 1 wherein:

the first bow limb is a split bow limb having top and bottom portions; and the second bow limb is a split bow limb having top and bottom portions.

7. A crossbow comprising:

a main beam having an axis of elongation;

a first bow limb that has: a first end supported to the main beam and a second end opposite the first end;

a second bow limb that has: a first end supported to the main beam and a second end opposite the first end; and a bowstring that is: adapted to propel an arrow, received on the second end of the first bow limb and received on the second end of the second bow limb;

wherein:

(1) the first end of the first bow limb and the first end of the second bow limb are separated such that a minimum distance between them is:

(a) at least as wide as a user's foot; but (b) not greater than about 5 inches;

(2) a first point is located on the first end of the first bow limb;

(3) a second point is located on the first end of the second bow limb;

(4) a first plane is perpendicular to the axis of elongation and intersects the first point;

(5) a second plane is perpendicular to the axis of elongation and intersects the second point;

(6) the first end of the first bow limb is positioned at a first acute angle with respect to the first plane;

(7) the first end of the second bow limb is positioned at a second acute angle with respect to the second plane;
(8) the first acute angle is between 60 and 30 degrees; and
(9) the second acute angle is between 60 and 30 degrees.

8. The crossbow of claim 7 wherein:
a first limb pocket receives the first end of the first bow limb; and
a second limb pocket receives the first end of the second bow limb.

9. The crossbow of claim 7 wherein:
the first bow limb has a length that is less than or equal to 12 inches; and
the second bow limb has a length that is less than or equal to 12 inches.

10. The crossbow of claim 7 wherein:
the first bow limb has a hinge point and a thickness that varies continuously along its length from the first end to the hinge point; and
the second bow limb has a hinge point and a thickness that varies continuously along its length from the first end to the hinge point.

11. The crossbow of claim 7 wherein:
the first acute angle is about 36 degrees; and
the second acute angle is about 36 degrees.

12. The crossbow of claim 7 wherein:
the first bow limb has a concave surface that faces a first side of the axis of elongation; and
the second bow limb has a concave surface that faces a second side of the axis of elongation that is opposite the first side.

13. The crossbow of claim 7 further comprising:
a riser that has: a first limb attachment surface, a second limb attachment surface and a connection portion;
wherein:
(1) the first end of the first bow limb is attached to the first limb attachment surface;
(2) the first end of the second bow limb is attached to the second limb attachment surface; and
(3) the connection portion is attached to the main beam.

14. A crossbow comprising:
a main beam having an axis of elongation;
a first bow limb that has: a first end supported to the main beam and a second end opposite the first end;
a second bow limb that has: a first end supported to the main beam and a second end opposite the first end;
a bowstring that is: adapted to propel an arrow as it moves on a first plane between cocked and uncocked positions, received on the second end of the first bow limb and received on the second end of the second bow limb; and
a foot stirrup supported to the main beam;
wherein:
(1) the foot stirrup begins behind the first ends of the first and second bow limbs and extends beyond the first ends of the first and second bow limbs such that a user's foot is insertable into the foot stirrup;
(2) a first point is located on the first end of the first bow limb;
(3) a second point is located on the foot stirrup;
(4) a second plane is perpendicular to the axis of elongation and intersects the first point;
(5) the axis of elongation lies on a third plane that is perpendicular to the first and second planes; and
(6) a fourth plane that is parallel to the third plane simultaneously intersects the first and second points.

15. The crossbow of claim 14 wherein:
a first limb pocket receives the first end of the first bow limb; and
a second limb pocket receives the first end of the second bow limb.

16. The crossbow of claim 14 wherein:
the first bow limb has a length that is less than or equal to 12 inches; and
the second bow limb has a length that is less than or equal to 12 inches.

17. The crossbow of claim 14 wherein:
the first bow limb has a hinge point and a thickness that varies continuously along its length from the first end to the hinge point; and
the second bow limb has a hinge point and a thickness that varies continuously along its length from the first end to the hinge point.

18. The crossbow of claim 14 further comprising:
a first wheel that: is designed to receive the bowstring, is supported to the second end of the first bow limb and is pivotal with respect to the first bow limb about a first pivot axis;
a second wheel that: is designed to receive the bowstring, is supported to the second end of the second bow limb and is pivotal with respect to the second bow limb about a second pivot axis; and
wherein:
(1) the first pivot axis and the second pivot axis are separated by a wheel distance (WD) when the crossbow is in the uncocked position; and
(2) the wheel distance WD is 24 inches or less.

19. The crossbow of claim 14 wherein:
a third point is located on the second limb attachment surface;
a fourth point is located on the foot stirrup; and
a fifth plane that is parallel to the third plane simultaneously intersects the third and fourth points.

20. The crossbow of claim 14 wherein:
the second point is positioned beyond the first ends of the first and second bow limbs.

* * * * *